US010920566B1

(12) United States Patent
Shen et al.

(10) Patent No.: US 10,920,566 B1
(45) Date of Patent: Feb. 16, 2021

(54) RATE OF PENETRATION DRILLING OPERATION CONTROLLER

(71) Applicant: Schlumberger Technology Corporation, Sugar Land, TX (US)

(72) Inventors: Yuelin Shen, Spring, TX (US); Zhengxin Zhang, Spring, TX (US); Wei Chen, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/584,730

(22) Filed: Sep. 26, 2019

(51) Int. Cl.

| | |
|---|---|
| ***E21B 44/06*** | (2006.01) |
| ***E21B 45/00*** | (2006.01) |
| ***E21B 4/02*** | (2006.01) |
| ***E21B 21/08*** | (2006.01) |
| *E21B 7/04* | (2006.01) |

(52) U.S. Cl.
CPC ..... *E21B 44/06* (2013.01); *E21B 4/02* (2013.01); *E21B 21/08* (2013.01); *E21B 45/00* (2013.01); *E21B 7/04* (2013.01)

(58) Field of Classification Search
None
See application file for complete search history.

(56) References Cited

U.S. PATENT DOCUMENTS

2016/0168917 A1 6/2016 Azar

OTHER PUBLICATIONS

Duplantis, Slide Drilling—Farther and Faster, Oilfield Review 28, No. 2 (May 2016), pp. 50-56 (7 pages).
Schlumberger, Brochure, Drillstring Vibrations and Vibration Modeling, Document 10 DR-0263, 2010 (4 pages).
Schlumberger, Brochure, PowerDrive Archer, High build rate rotary steerable system for increased reservoir exposure, Document 13 DR-0004, 2013 (7 pages).
SmithBits (a Schlumberger Company), Product Catalog, Document 17-BDT-310907, 2018, pp. 1-87 (44 pages, two pp per page for size) (see, e.g., p. 7-16, Engineering and Modeling, IDEAS integrated dynamic design and analysis platform).
Raymond and Grossman, Development and Testing of a Mudjet-Augmented PDC Bit, Sandia Report, SAND2006-0091, Jan. 2006 (179 pages) (see, e.g., p. 32, Figs. 18 and 19; pp. 89-90, 5. Conclusions).

*Primary Examiner* — Carlos R Ortiz Rodriguez
(74) *Attorney, Agent, or Firm* — Alec J. McGinn

(57) ABSTRACT

A method can include receiving a maximum depth of cut value of a bit that accounts for bit body formation engagement; receiving a total revolution rate value for the bit that is based at least in part on a differential pressure value of a mud motor; generating a rate of penetration value for the bit as operatively coupled to the mud motor by multiplying the maximum depth of cut value and the total revolution rate value; and operating a rigsite system according to the rate of penetration value for drilling a portion of a borehole using the bit as operatively coupled to the mud motor.

20 Claims, 24 Drawing Sheets

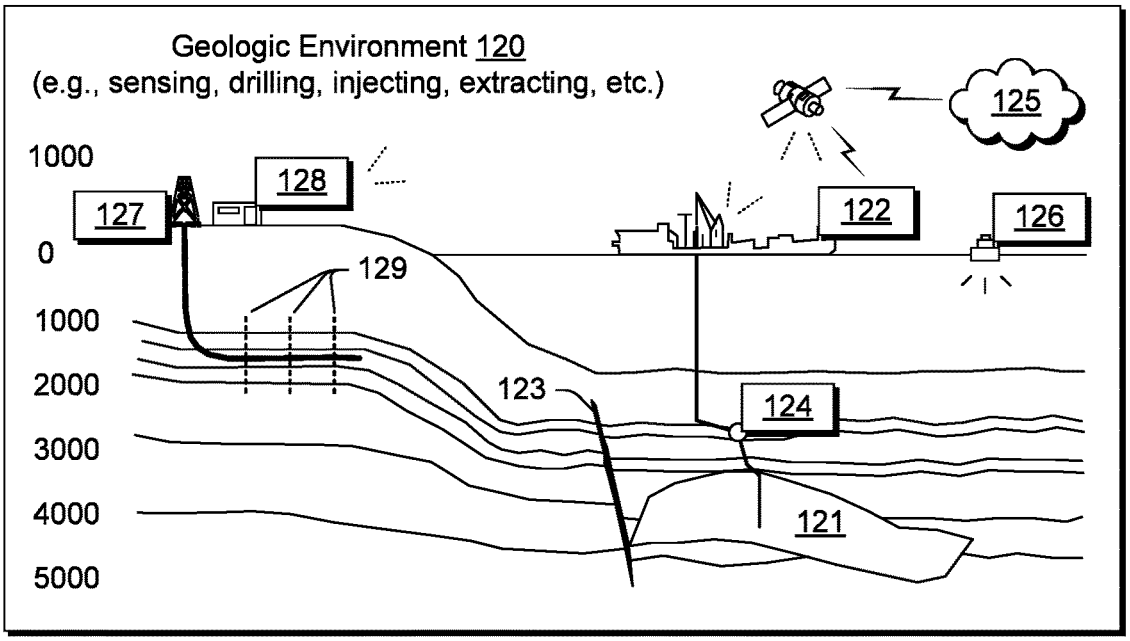
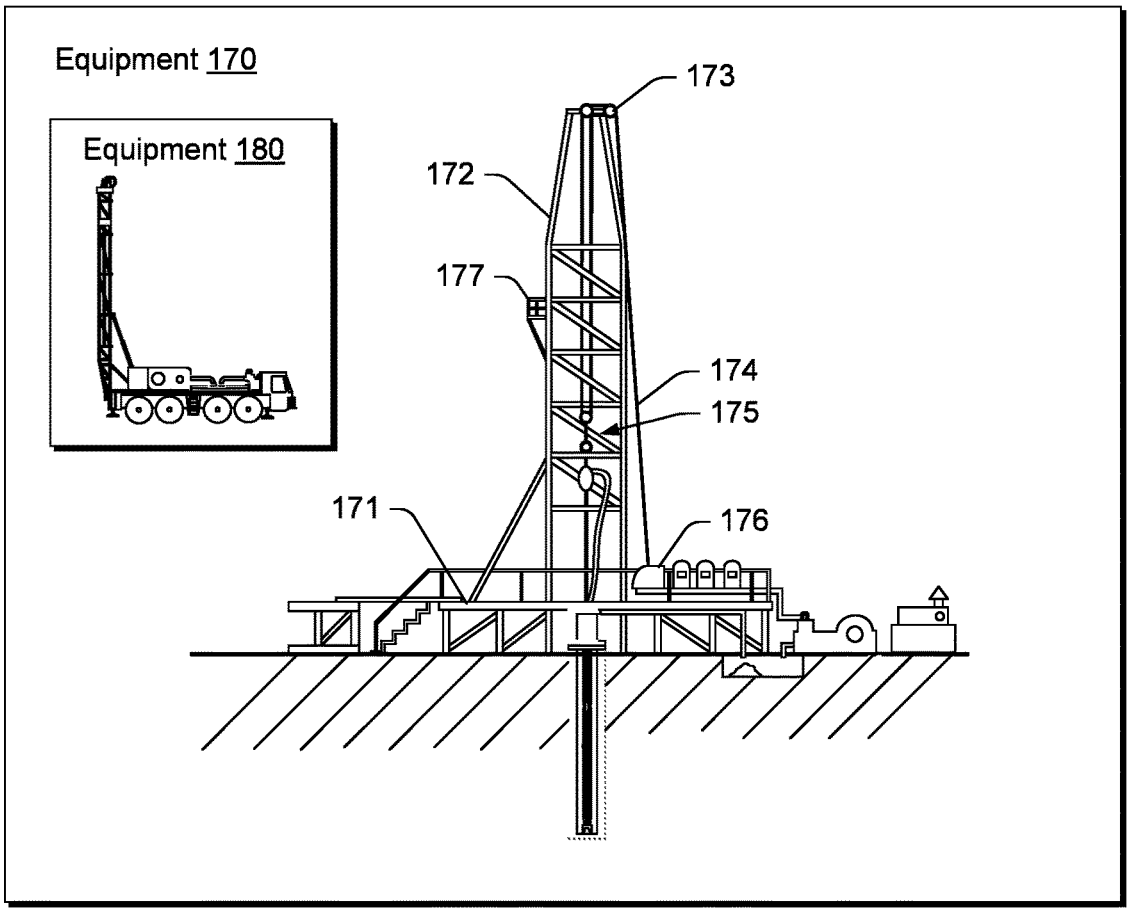
Fig. 1

Point Spreadsheet 670

| x | y | Depth | Pad Config. | Pad Orient. | Well Length | Vertical Spacing | Horiz. Spacing | Toe Height | Step Out | Initial Incl. | Kick Off |
|---|---|---|---|---|---|---|---|---|---|---|---|
| 11 | 93 | 217 | 2 | 90 | 2000 | 50 | 500 | 0 | 1000 | 0 | 0 |
| 11 | 94 | 384 | 1 | 90 | 1000 | 50 | 500 | 0 | 1000 | 0 | 0 |
| 12 | 95 | 282 | 1 | 90 | 1000 | 50 | 500 | 0 | 1000 | 0 | 0 |

GUI 900

| | | ET(h) | TT (days) |
|---|---|---|---|
| | ▽Construct Well | | |
| | ▷Construct Section 17.5 in | 59.91 | 2.50 |
| | ▷Construct Section 12.5 in | 106.61 | 6.94 |
| | ▽Construct Section 8.5 in | | |
| | Drilling run (3530-6530ft) | | |
| | Safety Meeting | 0.25 | 6.95 |
| | Make up BHA | 2.04 | 7.03 |
| | Trip in to depth (0-1030ft) | 0.87 | 7.07 |
| | Drill shoe track (1030-3530ft) | 1.02 | 7.11 |
| 910 | Drill to depth (3530-6530ft) | 102.08 | 11.37 |
| | Circulate to condition hole | 1.02 | 11.41 |
| | Conduct flow check | 0.25 | 11.42 |
| | Pump slug sweep pill spacer | 0.25 | 11.43 |
| | Trip out to depth (6530-0ft) | 5.54 | 11.66 |
| | Lay down BHA | 2.04 | 11.75 |
| | Wireline run | | |
| | Make up wireline toolstring | 2.04 | 11.83 |
| | Run in wireline to depth (0-6530ft) | 1.85 | 11.91 |
| | Up log wireline to depth (3070-0ft) | 5.09 | 12.12 |
| | Lay down wireline toolstring | 2.04 | 12.23 |
| | ⋮ | | |

Fig. 9

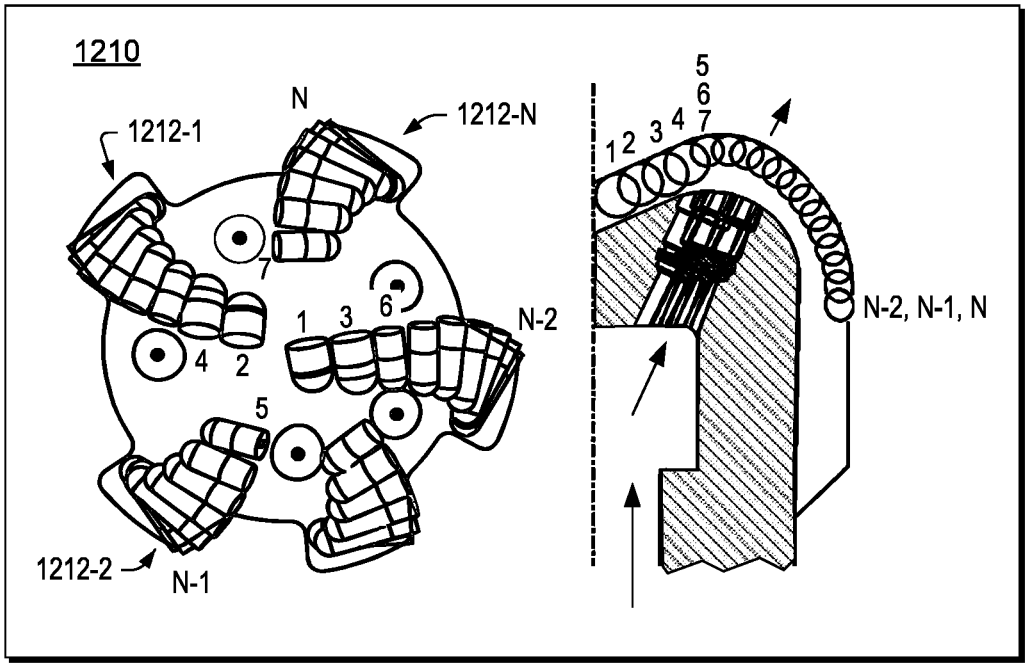
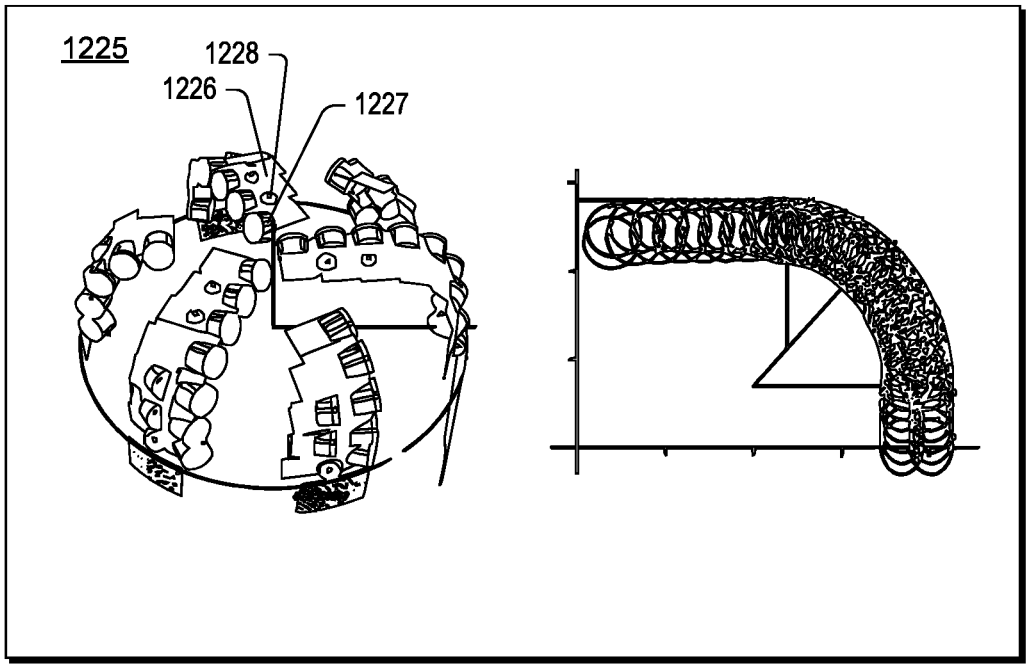
Fig. 12

GUI 1500

| Parameters | Model Parameters |
|---|---|
| Rotor Ecc. | Power Section Type |
| Max Flow Rate | Elastomer Type |
| Min Flow Rate | Fit Profile Type |
| Stator Major | Fit Adjustment |
| Rotor Major | Mud Density |
| Rotor Minor | Mud Temp |
| Rotor Lobes | Ref. Temp |
| Stator Stages | Hydraulic Pressure |

| Curve Type | Flow Rate Type | Data Type |
|---|---|---|
| RPM & Torque vs. Diff. Press. | As above | Modified Data |

GUI 1900

| Stability ROP Sensitivity | | | | | |
|---|---|---|---|---|---|
| DP(psi) | WOB(klbf) | | | | |
| 464 | 25 | **0.94** | **1.1** | **1.17** | **1.26** |
| 389 | 20 | **0.76** | **0.88** | **0.94** | **1** |
| 308 | 15 | **0.56** | **0.65** | **0.69** | **0.73** |
| 220 | 10 | **0.36** | **0.41** | **0.43** | **0.46** |
| | SRPM | 30 | 50 | 60 | 70 |
| | FLOW | 250 | 250 | 250 | 250 |
| | ROP - normalized by 150.12 (ft/h) | | | | |

| Stability Sensitivity Legend | | |
|---|---|---|
| All | | |
| Lat-Sti | | |
| Axi-Sti | | |
| Axi-Lat | | |
| Sti(40) | | |
| Lat(3.0) | | ● |
| Axi(1.0) | | |
| Stable | | ○ |

| |
|---|
| Lat: Lateral Vibration Risk ● |
| Axi: Axial Vibration Risk |
| Sti: Stick-Slip Risk |

Fig. 19

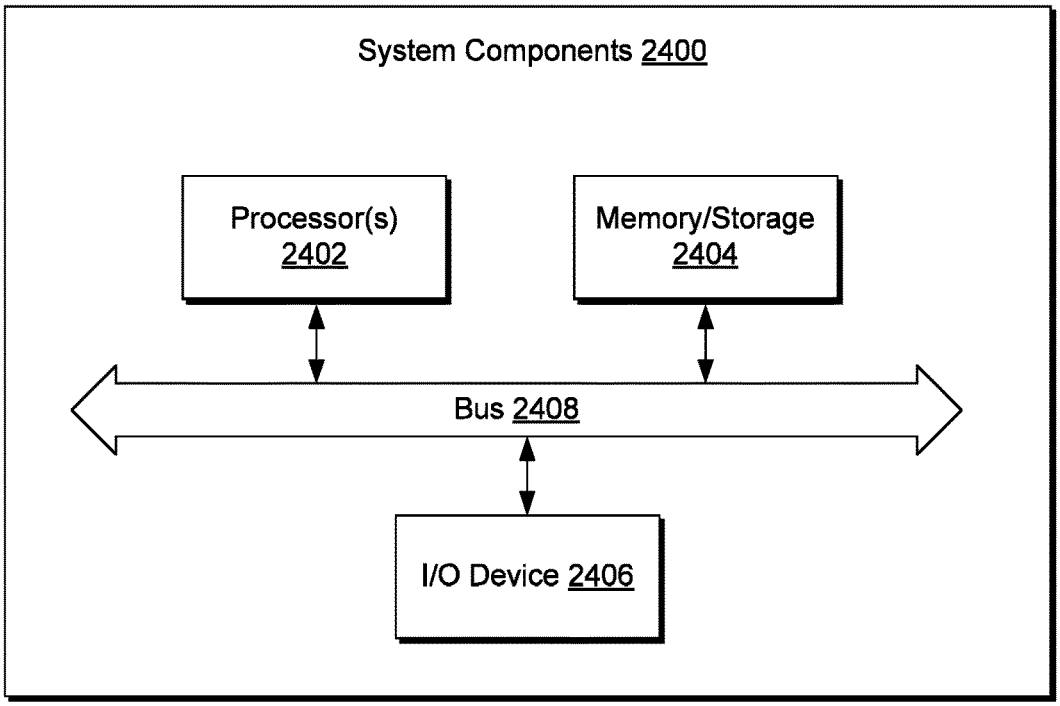
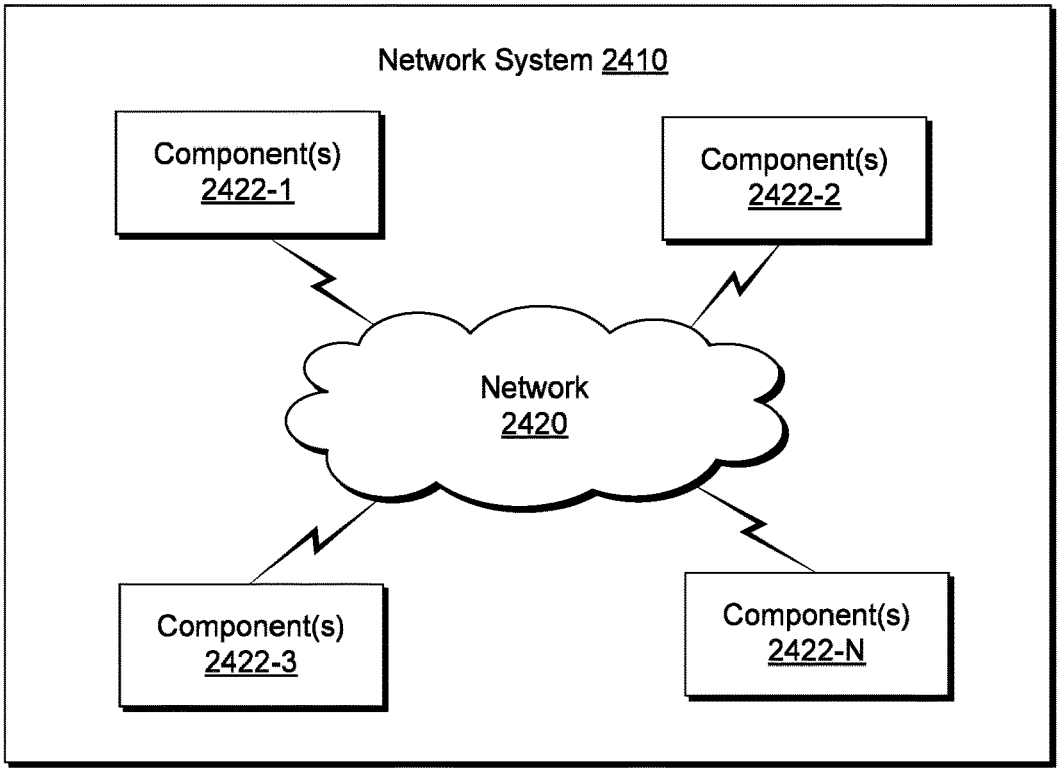
Fig. 24

RATE OF PENETRATION DRILLING OPERATION CONTROLLER

BACKGROUND

A resource field can be an accumulation, pool or group of pools of one or more resources (e.g., oil, gas, oil and gas) in a subsurface environment. A resource field can include at least one reservoir. A reservoir may be shaped in a manner that can trap hydrocarbons and may be covered by an impermeable or sealing rock. A bore can be drilled into an environment where the bore may be utilized to form a well that can be utilized in producing hydrocarbons from a reservoir.

A rig can be a system of components that can be operated to form a bore in an environment, to transport equipment into and out of a bore in an environment, etc. As an example, a rig can include a system that can be used to drill a bore and to acquire information about an environment, about drilling, etc. A resource field may be an onshore field, an offshore field or an on- and offshore field. A rig can include components for performing operations onshore and/or offshore. A rig may be, for example, vessel-based, offshore platform-based, onshore, etc.

Field planning and/or development can occur over one or more phases, which can include an exploration phase that aims to identify and assess an environment (e.g., a prospect, a play, etc.), which may include drilling of one or more bores (e.g., one or more exploratory wells, etc.).

SUMMARY

A method can include receiving a maximum depth of cut value of a bit that accounts for bit body formation engagement; receiving a total revolution rate value for the bit that is based at least in part on a differential pressure value of a mud motor; generating a rate of penetration value for the bit as operatively coupled to the mud motor by multiplying the maximum depth of cut value and the total revolution rate value; and operating a rigsite system according to the rate of penetration value for drilling a portion of a borehole using the bit as operatively coupled to the mud motor. A system can include a processor; memory accessible by the processor; processor-executable instructions stored in the memory and executable to instruct the system to: receive a maximum depth of cut value of a bit that accounts for bit body formation engagement; receive a total revolution rate value for the bit that is based at least in part on a differential pressure value of a mud motor; generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor. One or more computer-readable storage media can include processor-executable instructions to instruct a computing system to: receive a maximum depth of cut value of a bit that accounts for bit body formation engagement; receive a total revolution rate value for the bit that is based at least in part on a differential pressure value of a mud motor; generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 9 illustrates an example of a graphical user interface;

FIG. 12 illustrates an example of a bit and an example of a computer-aided design bit;

FIG. 19 illustrates an example of a graphical user interface;

FIG. 24 illustrates example components of a system and a networked system.

DETAILED DESCRIPTION

Figure 2:
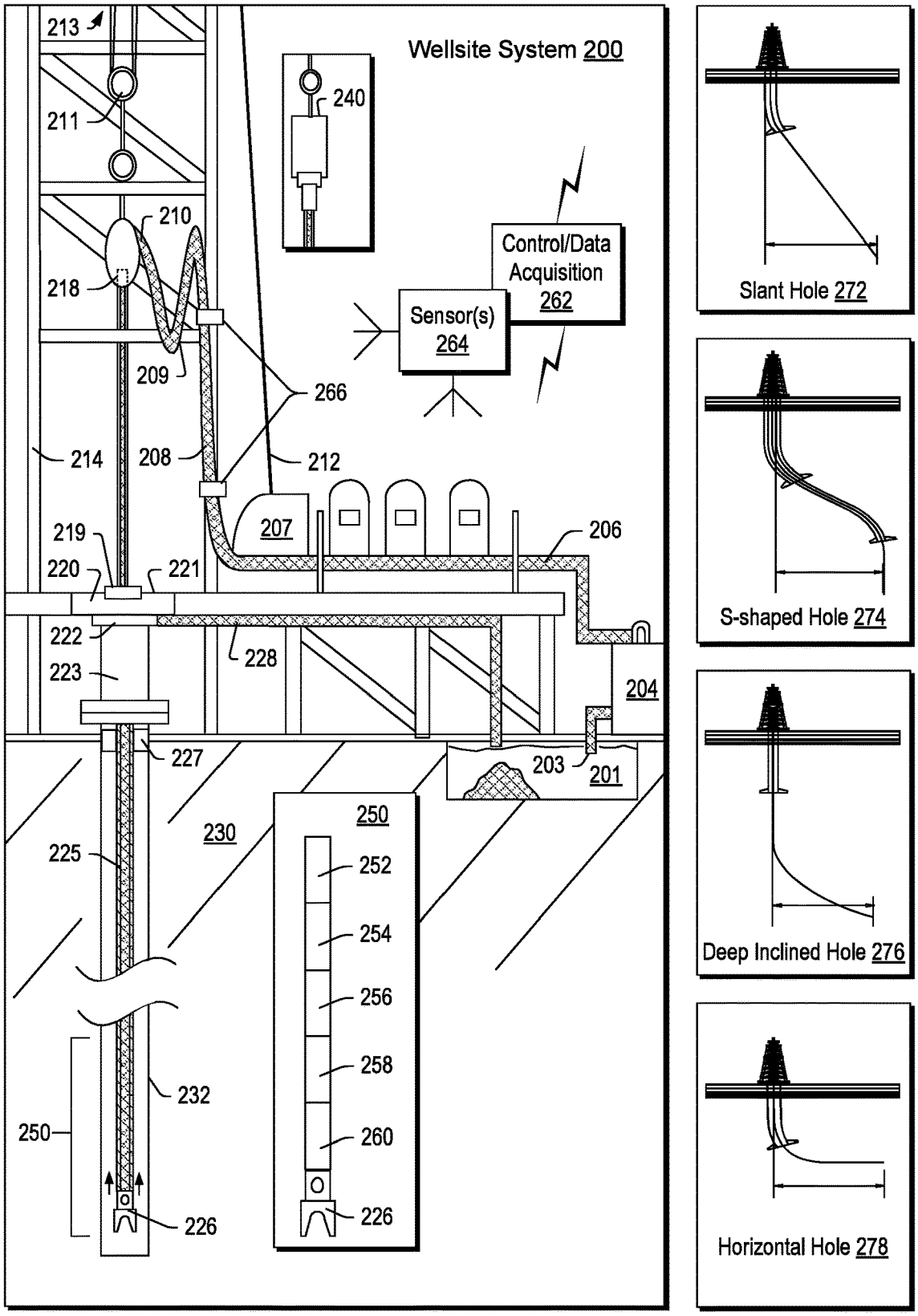
FIG. 2 illustrates examples of equipment and examples of hole types.

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion (e.g., a lateral portion) that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system (e.g., an offshore rig, etc.).

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrickman may be a rig crew member that works on a platform attached to a derrick or a mast. A derrick can include a landing on which a derrickman may stand. As an example, such a landing may be about 10 meters or more above a rig floor. In an operation referred to as trip out of the hole (TOH), a derrickman may wear a safety harness that enables leaning out from the work landing (e.g., monkeyboard) to reach pipe located at or near the center of a derrick or a mast and to throw a line around the pipe and pull it back into its storage location (e.g., fingerboards), for example, until it may be desirable to run the pipe back into the bore. As an example, a rig may include automated pipe-handling equipment such that the derrickman controls the machinery rather than physically handling the pipe.

As an example, a trip may refer to the act of pulling equipment from a bore and/or placing equipment in a bore. As an example, equipment may include a drillstring that can be pulled out of a hole and/or placed or replaced in a hole. As an example, a pipe trip may be performed where a drill bit has dulled or has otherwise ceased to drill efficiently and is to be replaced. As an example, a trip that pulls equipment out of a borehole may be referred to as pulling out of hole (POOH) and a trip that runs equipment into a borehole may be referred to as running in hole (RIH).

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the traveling block 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring can include a plurality of tools.

As to a RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling can commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor can present some challenges depending on factors such as rate of penetration (ROP), transferring weight to a bit (e.g., weight on bit, WOB) due to friction, etc. A mud motor can be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM can be determined or estimated as a sum of the SRPM and the mud motor RPM, assuming the SRPM and the mud motor RPM are in the same direction.

As an example, a PDM mud motor can operate in a so-called sliding mode, when the drillstring is not rotated from the surface. In such an example, a bit RPM can be determined or estimated based on the RPM of the mud motor.

A RSS can drill directionally where there is continuous rotation from surface equipment, which can alleviate the sliding of a steerable motor (e.g., a PDM). A RSS may be deployed when drilling directionally (e.g., deviated, horizontal, or extended-reach wells). A RSS can aim to minimize interaction with a borehole wall, which can help to preserve borehole quality. A RSS can aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As mentioned, a steerable system can be or include an RSS. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
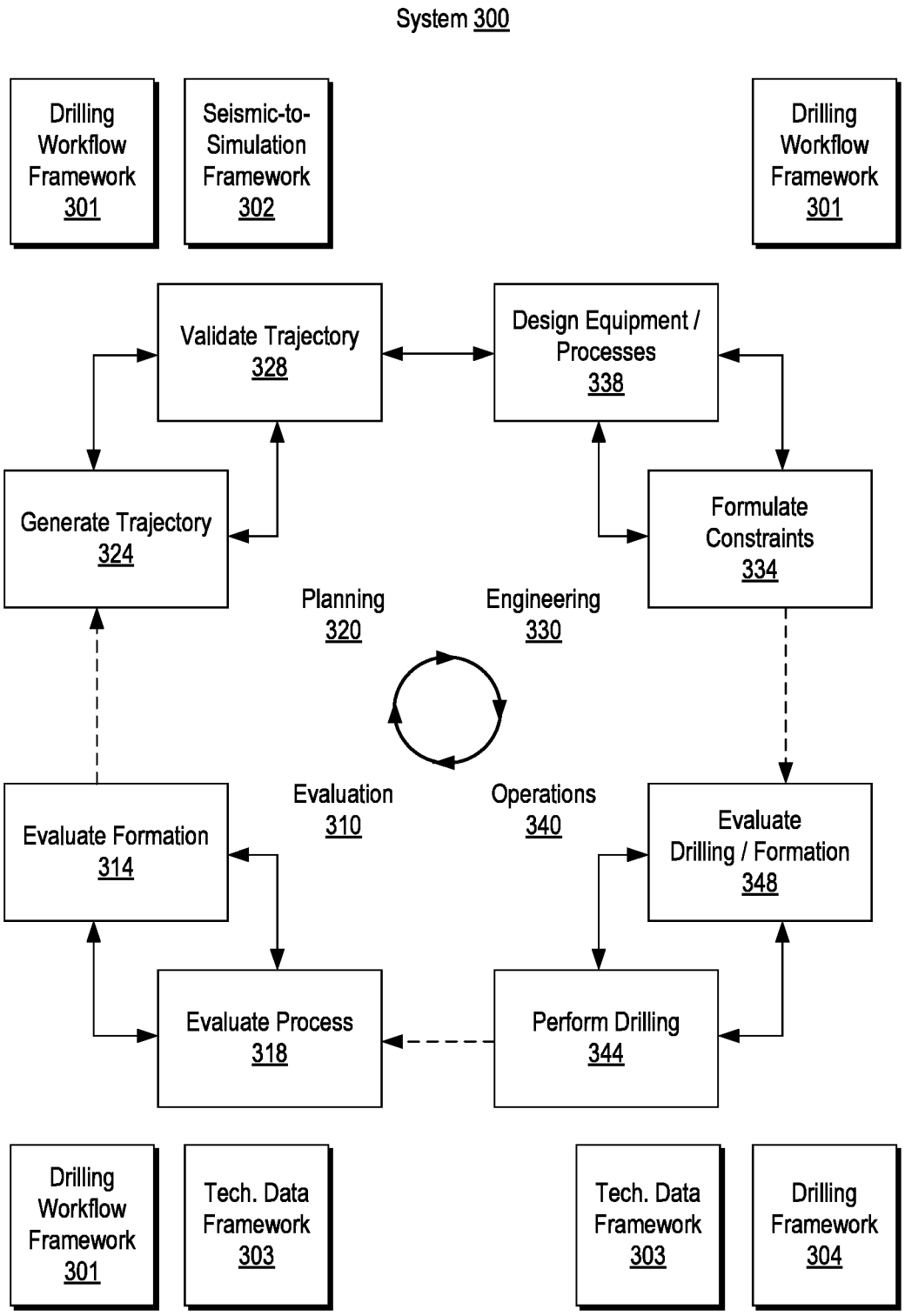
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL framework (Schlumberger, Houston, Tex.) and the technical data framework 303 can be, for example, the TECH LOG framework (Schlumberger, Houston, Tex.).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. An example of an object-based framework is the MICROSOFT .NET framework (Redmond, Wash.), which provides a set of extensible object classes. In the .NET framework, an object class encapsulates a module of reusable code and associated data structures. Object classes can be used to instantiate object instances for use in by a program, script, etc. For example, borehole classes may define objects for representing boreholes based on well data.

As an example, a framework may be implemented within or in a manner operatively coupled to the DELFI cognitive exploration and production (E&P) environment (Schlumberger, Houston, Tex.), which is a secure, cognitive, cloud-based collaborative environment that integrates data and workflows with digital technologies, such as artificial intelligence and machine learning. As an example, such an environment can provide for operations that involve one or more frameworks.

As an example, a framework can include an analysis component that may allow for interaction with a model or model-based results (e.g., simulation results, etc.). As to simulation, a framework may operatively link to or include a simulator such as the ECLIPSE reservoir simulator (Schlumberger, Houston Tex.), the INTERSECT reservoir simulator (Schlumberger, Houston Tex.), etc.

The aforementioned PETREL framework provides components that allow for optimization of exploration and development operations. The PETREL framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As mentioned with respect to the DELFI environment, one or more frameworks may be interoperative and/or run upon one or another. As an example, a framework environment marketed as the OCEAN framework environment (Schlumberger, Houston, Tex.) may be utilized, which allows for integration of add-ons (or plug-ins) into a PETREL framework workflow. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. In a framework environment (e.g., OCEAN, DELFI, etc.), a model simulation layer can include or operatively link to a model-centric framework. In an example embodiment, a framework may be considered to be a data-driven application. For example, the PETREL framework can include features for model building and visualization. As an example, a model may include one or more grids where a grid can be a spatial grid that conforms to spatial locations per acquired data (e.g., satellite data, logging data, seismic data, etc.).

As an example, a model simulation layer may provide domain objects, act as a data source, provide for rendering and provide for various user interfaces. Rendering capabilities may provide a graphical environment in which applications can display their data while user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL framework, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA framework, marketed by Schlumberger, Houston, Tex.) may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL framework, etc.).

As an example, a workflow may be a process implementable at least in part in a framework environment and by one or more frameworks. As an example, a workflow may include one or more worksteps that access a set of instructions such as a plug-in (e.g., external executable code, etc.). As an example, a framework environment may be cloud-based where cloud resources are utilized that may be operatively coupled to one or more pieces of field equipment such that data can be acquired, transmitted, stored, processed, analyzed, etc., using features of a framework environment. As an example, a framework environment may employ various types of services, which may be backend, frontend or backend and frontend services. For example, consider a client-server type of architecture where communications may occur via one or more application programming interfaces (APIs), one or more microservices, etc.

As an example, a framework may provide for modeling petroleum systems. For example, the modeling framework marketed as the PETROMOD framework (Schlumberger, Houston, Tex.), which includes features for input of various types of information (e.g., seismic, well, geological, etc.) to model evolution of a sedimentary basin. The PETROMOD framework provides for petroleum systems modeling via input of various data such as seismic data, well data and other geological data, for example, to model evolution of a sedimentary basin. The PETROMOD framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL framework, workflows may be constructed to provide basin-to-prospect scale exploration solutions. Data exchange between frameworks can facilitate construction of models, analysis of data (e.g., PETROMOD framework data analyzed using PETREL framework capabilities), and coupling of workflows.

As mentioned, a drillstring can include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger, Houston, Tex.) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG framework. As an example, the TECHLOG framework can be interoperable with one or more other frameworks such as, for example, the PETREL framework.

As an example, various aspects of a workflow may be completed automatically, may be partially automated, or may be completed manually, as by a human user interfacing with a software application that executes using hardware (e.g., local and/or remote). As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 314). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 324), which may involve execution of one or more G&G software packages. Examples of such software packages include the PETREL framework. As an example, a G&G service provider may determine a well trajectory or a section thereof, based on, for example, one or more model(s) provided by a formation evaluation (e.g., per the evaluation block 314), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 328). Such a validation process may include evaluating physical properties, calculations, risk tolerances, integration with other aspects of a workflow, etc. As an example, one or more parameters for such determinations may be maintained by a server and/or by the first engineering service provider; noting that one or more model(s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 338). In some embodiments, a second engineering service provider may perform such design using one of more software applications. Such designs may be stored in one or more databases maintained by one or more servers, which may, for example, employ STUDIO framework tools (Schlumberger, Houston, Tex.), and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 334). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well (e.g., a trajectory) that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: transport (e.g., moving items unnecessarily, whether physical or data); inventory (e.g., components, whether physical or informational, as work in process, and finished product not being processed); motion (e.g., people or equipment moving or walking unnecessarily to perform desired processing); waiting (e.g., waiting for information, interruptions of production during shift change, etc.); overproduction (e.g., production of material, information, equipment, etc. ahead of demand); over processing (e.g., resulting from poor tool or product design creating activity); and defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 4:
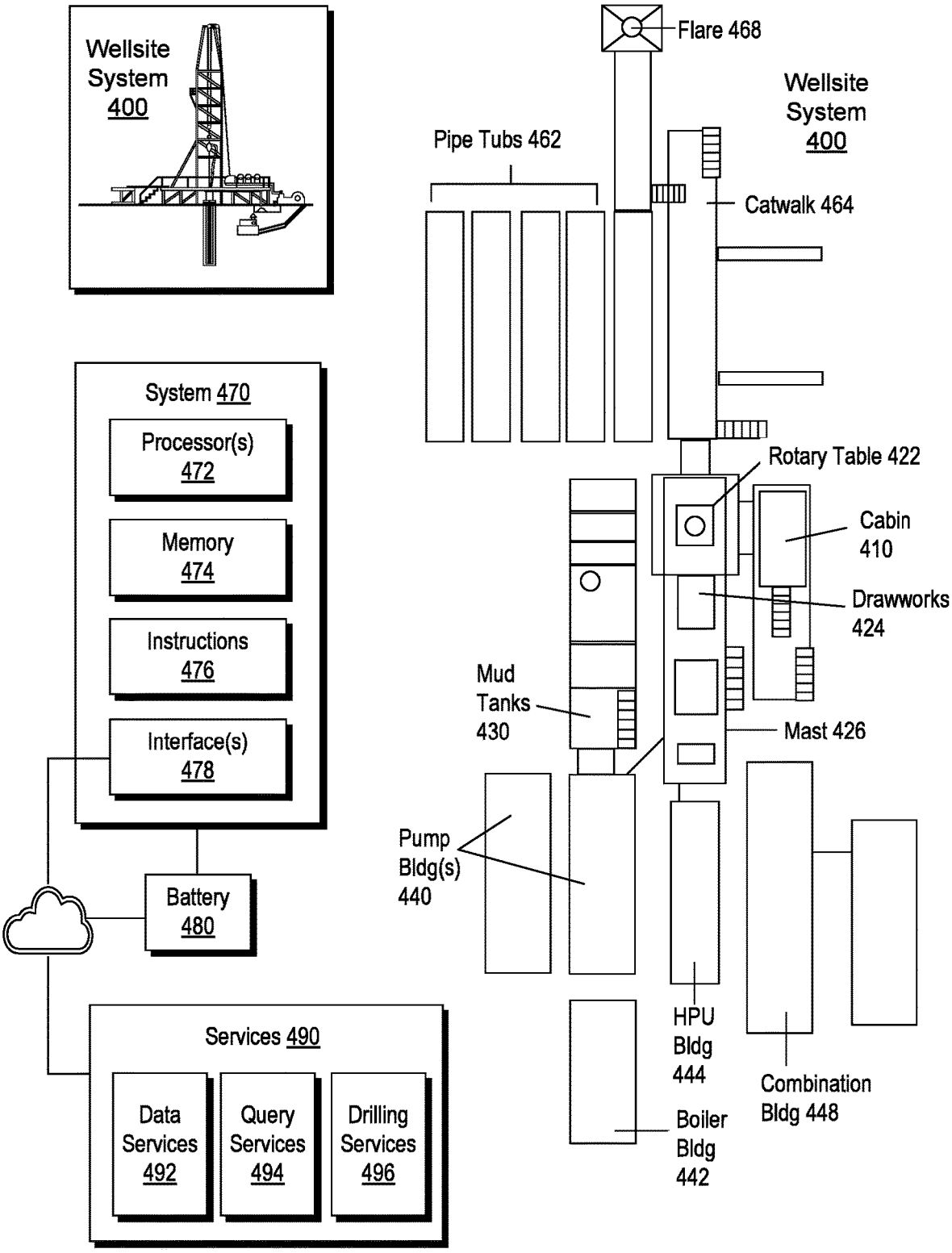
FIG. 4 illustrates an example of a wellsite system and an example of a computing system.

FIG. 4 shows an example of a wellsite system 400, specifically, FIG. 4 shows the wellsite system 400 in an approximate side view and an approximate plan view along with a block diagram of a system 470.

In the example of FIG. 4, the wellsite system 400 can include a cabin 410, a rotary table 422, drawworks 424, a mast 426 (e.g., optionally carrying a top drive, etc.), mud tanks 430 (e.g., with one or more pumps, one or more shakers, etc.), one or more pump buildings 440, a boiler building 442, an HPU building 444 (e.g., with a rig fuel tank, etc.), a combination building 448 (e.g., with one or more generators, etc.), pipe tubs 462, a catwalk 464, a flare 468, etc. Such equipment can include one or more associated functions and/or one or more associated operational risks, which may be risks as to time, resources, and/or humans.

As shown in the example of FIG. 4, the wellsite system 400 can include a system 470 that includes one or more processors 472, memory 474 operatively coupled to at least one of the one or more processors 472, instructions 476 that can be, for example, stored in the memory 474, and one or more interfaces 478. As an example, the system 470 can include one or more processor-readable media that include processor-executable instructions executable by at least one of the one or more processors 472 to cause the system 470 to control one or more aspects of the wellsite system 400. In such an example, the memory 474 can be or include the one or more processor-readable media where the processor-executable instructions can be or include instructions. As an example, a processor-readable medium can be a computer-readable storage medium that is not a signal and that is not a carrier wave.

FIG. 4 also shows a battery 480 that may be operatively coupled to the system 470, for example, to power the system 470. As an example, the battery 480 may be a back-up battery that operates when another power supply is unavailable for powering the system 470. As an example, the battery 480 may be operatively coupled to a network, which may be a cloud network. As an example, the battery 480 can include smart battery circuitry and may be operatively coupled to one or more pieces of equipment via a SMBus or other type of bus.

In the example of FIG. 4, services 490 are shown as being available, for example, via a cloud platform. Such services can include data services 492, query services 494 and drilling services 496. As an example, the services 490 may be part of a system such as the system 300 of FIG. 3.

As an example, the system 470 may be utilized to generate one or more rate of penetration (ROP) values and/or to receive one or more ROP values, which may, for example, be utilized to control one or more drilling operations.

Figure 5:
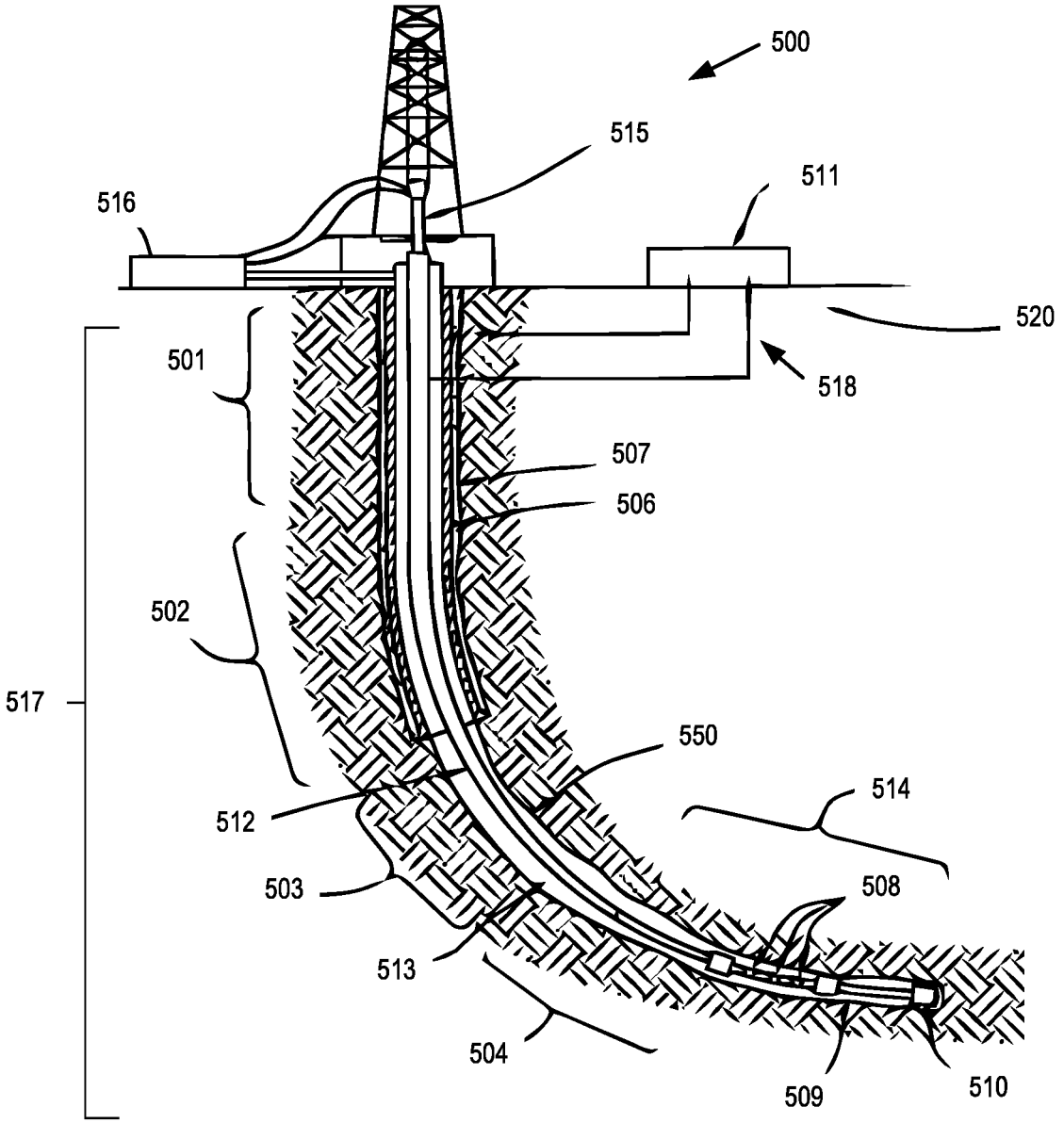
FIG. 5 illustrates an example of equipment in a geologic environment.

FIG. 5 shows a schematic diagram depicting an example of a drilling operation of a directional well in multiple sections. The drilling operation depicted in FIG. 5 includes a wellsite drilling system 500 and a field management tool 520 for managing various operations associated with drilling a bore hole 550 of a directional well 517. The wellsite drilling system 500 includes various components (e.g., drillstring 512, annulus 513, bottom hole assembly (BHA) 514, kelly 515, mud pit 516, etc.). As shown in the example of FIG. 5, a target reservoir may be located away from (as opposed to directly under) the surface location of the well 517. In such an example, special tools or techniques may be used to ensure that the path along the bore hole 550 reaches the particular location of the target reservoir.

As an example, the BHA 514 may include sensors 508, a rotary steerable system (RSS) 509, and a bit 510 to direct the drilling toward the target guided by a pre-determined survey program for measuring location details in the well. Furthermore, the subterranean formation through which the directional well 517 is drilled may include multiple layers (not shown) with varying compositions, geophysical characteristics, and geological conditions. Both the drilling planning during the well design stage and the actual drilling according to the drilling plan in the drilling stage may be performed in multiple sections (see, e.g., sections 501, 502, 503 and 504), which may correspond to one or more of the multiple layers in the subterranean formation. For example, certain sections (e.g., sections 501 and 502) may use cement 507 reinforced casing 506 due to the particular formation compositions, geophysical characteristics, and geological conditions.

In the example of FIG. 5, a surface unit 511 may be operatively linked to the wellsite drilling system 500 and the field management tool 520 via communication links 518. The surface unit 511 may be configured with functionalities to control and monitor the drilling activities by sections in real time via the communication links 518. The field management tool 520 may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 518 according to a drilling operation workflow. The communication links 518 may include a communication subassembly.

During various operations at a wellsite, data can be acquired for analysis and/or monitoring of one or more operations. Such data may include, for example, subterranean formation, equipment, historical and/or other data. Static data can relate to, for example, formation structure and geological stratigraphy that define the geological structures of the subterranean formation. Static data may also include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gas oil ratio, water cut, and/or other fluid compositional information), and states of various equipment, and other information.

The static and dynamic data collected via a bore, a formation, equipment, etc. may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

As an example, a system can include a framework that can acquire data such as, for example, real time data associated with one or more operations such as, for example, a drilling operation or drilling operations. As an example, consider the PERFORM™ toolkit framework (Schlumberger Limited, Houston, Tex.).

As an example, a service can be or include one or more of OPTIDRILL™, OPTILOG™ and/or other services marketed by Schlumberger Limited, Houston, Tex.

The OPTIDRILL™ technology can help to manage downhole conditions and BHA dynamics as a real time drilling intelligence service. The service can incorporate a rigsite display (e.g., a wellsite display) of integrated downhole and surface data that provides actionable information to mitigate risk and increase efficiency. As an example, such data may be stored, for example, to a database system (e.g., consider a database system associated with the STUDIO™ framework).

The OPTILOG™ technology can help to evaluate drilling system performance with single- or multiple-location measurements of drilling dynamics and internal temperature from a recorder. As an example, post-run data can be analyzed to provide input for future well planning.

As an example, information from a drill bit database may be accessed and utilized. For example, consider information from Smith Bits (Schlumberger Limited, Houston, Tex.), which may include information from various operations (e.g., drilling operations) as associated with various drill bits, drilling conditions, formation types, etc.

As an example, one or more QTRAC services (Schlumberger Limited, Houston Tex.) may be provided for one or more wellsite operations. In such an example, data may be acquired and stored where such data can include time series data that may be received and analyzed, etc.

As an example, one or more M-I SWACO™ services (M-I L.L.C., Houston, Tex.) may be provided for one or more wellsite operations. For example, consider services for value-added completion and reservoir drill-in fluids, additives, cleanup tools, and engineering. In such an example, data may be acquired and stored where such data can include time series data that may be received and analyzed, etc.

As an example, one or more ONE-TRAX™ services (e.g., via the ONE-TRAX software platform, M-I L.L.C., Houston, Tex.) may be provided for one or more wellsite operations. In such an example, data may be acquired and stored where such data can include time series data that may be received and analyzed, etc.

As an example, various operations can be defined with respect to WITS or WITSML, which are acronyms for well-site information transfer specification or standard (WITS) and markup language (WITSML). WITS/WITSML specify how a drilling rig or offshore platform drilling rig can communicate data. For example, as to slips, which are an assembly that can be used to grip a drillstring in a relatively non-damaging manner and suspend the drillstring in a rotary table, WITS/WITSML define operations such as "bottom to slips" time as a time interval between coming off bottom and setting slips, for a current connection; "in slips" as a time interval between setting the slips and then releasing them, for a current connection; and "slips to bottom" as a time interval between releasing the slips and returning to bottom (e.g., setting weight on the bit), for a current connection.

Well construction can occur according to various procedures, which can be in various forms. As an example, a procedure can be specified digitally and may be, for example, a digital plan such as a digital well plan. A digital well plan can be an engineering plan for constructing a wellbore. As an example, procedures can include information such as well geometries, casing programs, mud considerations, well control concerns, initial bit selections, offset well information, pore pressure estimations, economics and special procedures that may be utilized during the course of well construction, production, etc. While a drilling procedure can be carefully developed and specified, various conditions can occur that call for adjustment to a drilling procedure.

As an example, an adjustment can be made at a rigsite when acquisition equipment acquire information about conditions, which may be for conditions of drilling equipment, conditions of a formation, conditions of fluid(s), conditions as to environment (e.g., weather, sea, etc.), etc. Such an adjustment may be made on the basis of personal knowledge of one or more individuals at a rigsite. As an example, an operator may understand that conditions call for an increase in mudflow rate, a decrease in weight on bit, etc. Such an operator may assess data as acquired via one or more sensors (e.g., torque, temperature, vibration, etc.). Such an operator may call for performance of a procedure, which may be a test procedure to acquire additional data to understand better actual physical conditions and physical phenomena that may occur or that are occurring. An operator may be under one or more time constraints, which may be driven by physical phenomena, such as fluid flow, fluid pressure, compaction of rock, borehole stability, etc. In such an example, decision making by the operator can depend on time as conditions evolve. For example, a decision made at one fluid pressure may be sub-optimal at another fluid pressure in an environment where fluid pressure is changing. In such an example, timing as to implementing a decision as an adjustment to a procedure can have a broad ranging impact. An adjustment to a procedure that is made too late or too early can adversely impact other procedures compared to an adjustment to a procedure that is made at an optimal time (e.g., and implemented at the optimal time).

As an example, a system can include one or more automation assisted features. For example, consider a feature that can generate and/or receive one or more rate of penetration (ROP) values that can be utilized to control a drilling operation. In such an example, a driller may utilize a generated ROP value to control one or more pieces of equipment to drill a borehole at or near the generated ROP value. As an example, where automation can issue signals to one or more pieces of equipment, a controller can utilize a generated ROP value for automatic control. As explained, where a driller is involved in decision making and/or control, a generated ROP value may facilitate drilling as the driller may rely on the generated ROP value for making one or more adjustments to a drilling operation. Where one or more generated ROP values are received in advance and/or in real-time, drilling operations can be performed more efficiently, for example, with respect to time to drill a section, a portion of a section, an entire borehole, etc. Such an approach may take equipment integrity (e.g., health, etc.)

into consideration, for example, such an approach may account for risk of contact between a bit body and a formation and/or mud motor performance where a mud motor can be utilized to drive a bit.

Figure 6:
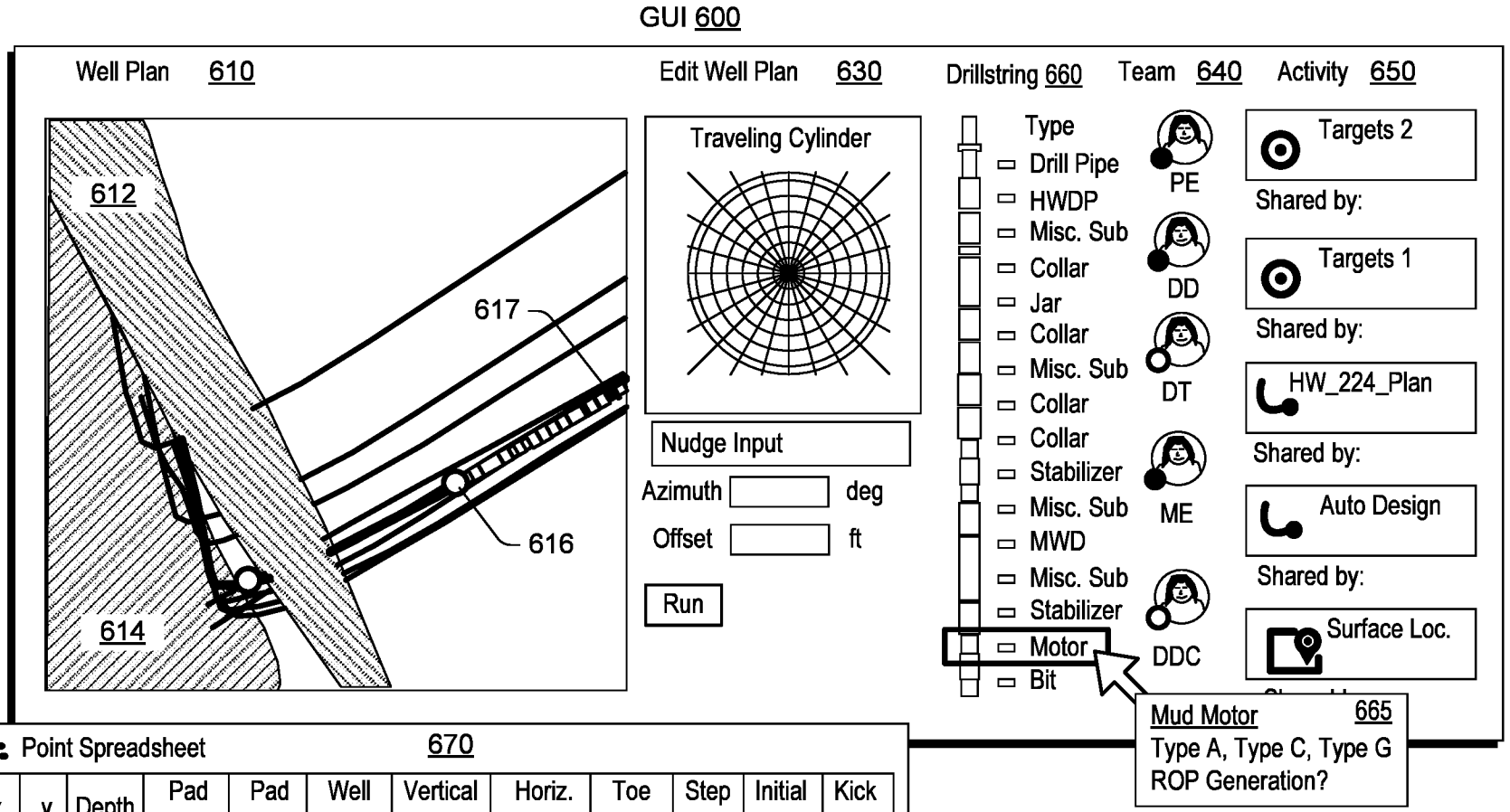
FIG. 6 illustrates an example of a graphical user interface.

FIG. 6 shows an example of a graphical user interface (GUI) 600 that includes information associated with a well plan. Specifically, the GUI 600 includes a panel 610 where surfaces representations 612 and 614 are rendered along with well trajectories where a location 616 can represent a position of a drillstring 617 along a well trajectory. The GUI 600 may include one or more editing features such as an edit well plan set of features 630. The GUI 600 may include information as to individuals of a team 640 that are involved, have been involved and/or are to be involved with one or more operations. The GUI 600 may include information as to one or more activities 650.

As shown in the example of FIG. 6, the GUI 600 can include a graphical control of a drillstring 660 where, for example, various portions of the drillstring 660 may be selected to expose one or more associated parameters (e.g., type of equipment, equipment specifications, operational history, etc.). In the example of FIG. 6, the drillstring graphical control 660 includes components such as drill pipe, heavy weight drill pipe (HWDP), subs, collars, jars, stabilizers, motor(s) and a bit. A drillstring can be a combination of drill pipe, a bottom hole assembly (BHA) and one or more other tools, which can include one or more tools that can help a drill bit turn and drill into material (e.g., a formation).

As an example, a workflow can include utilizing the graphical control of the drillstring 660 to select and/or expose information associated with a component or components such as, for example, a bit and/or a mud motor. As an example, in response to selection of a bit and/or a mud motor (e.g., consider a bit and mud motor combination), a computational framework (e.g., via an ROP engine, etc.) can generate one or more rate of penetration (ROP) values, which may be utilized, for example, as set points for purposes of performing one or more drilling operations. In the example of FIG. 6, a graphical control 665 is shown that can be rendered responsive to interaction with the graphical control of the drillstring 660, for example, to select a type of component and/or to generate one or more ROP values, etc.

FIG. 6 also shows an example of a table 670 as a point spreadsheet that specifies information for a plurality of wells. As shown in the example table 670, coordinates such as "x" and "y" and "depth" can be specified for various features of the wells, which can include pad parameters, spacings, toe heights, step outs, initial inclinations, kick offs, etc. (see also, e.g., FIG. 7 and various types of drilling operations as specified with respect to coordinates of a trajectory).

As mentioned, a well can be a direction well, which is constructed using directional drilling. Directional wells have been a boon to oil and gas production, particularly in unconventional plays, where horizontal and extended-reach wells can help to maximize wellbore exposure through productive zones.

One or more of various technologies can be utilized for directional drilling. For example, consider a steerable mud motor that can be utilized to achieve a desired borehole trajectory to and/or through one or more target zones. As an example, a directional drilling operation can use a downhole mud motor when they kick off the well, build angle, drill tangent sections and maintain trajectory.

A mud motor can include a bend in a motor bearing housing that provides for steering a bit toward a desired target. A bend can be surface adjustable (e.g., a surface adjustable bend (SAB)) and, for example, set at an angle in a range of operational angles (e.g., consider 0 degrees to approximate 5 degrees, 0 degrees to approximately 4 degrees, 0 degrees to approximately 3 degrees, etc.). The bend can aim to be sufficient for pointing the bit in a given direction while being small enough to permit rotation of the entire mud motor assembly during rotary drilling. The deflection cause by a bend can be a factor that determines a rate at which a mud motor can build angle to construct a desired borehole. By orienting the bend in a specific direction, referred to as a toolface angle, a drilling operation can change the inclination and azimuth of a borehole trajectory. To maintain the orientation of the bend, the drillstring is operated in a sliding mode where the entire drillstring itself does not rotate in the borehole (e.g., via a top drive, a rotary table, etc.) and where bit rotation for drilling is driven by a mud motor of the drillstring.

A mud motor is a type of positive displacement motor (PDM) powered by drilling fluid. As an example, a mud motor can include an eccentric helical rotor and stator assembly drive. As drilling fluid (e.g., mud) is pumped downhole, the drilling fluid flows through the stator and turns the rotor. The mud motor converts hydraulic power to mechanical power to turn a drive shaft that causes a bit operatively coupled to the mud motor to rotate.

Through use of a mud motor, a directional drilling operation can alternate between rotating and sliding modes of drilling. In the rotating mode, a rotary table or top drive is operated to rotate an entire drillstring to transmit power to a bit. As mentioned, the rotating mode can include combined rotation via surface equipment and via a downhole mud motor. In the rotating mode, rotation enables a bend in the motor bearing housing to be directed equally across directions and thus maintain a straight drilling path. As an example, one or more measurement-while-drilling (MWD) tools integrated into a drillstring can provide real-time inclination and azimuth measurements. Such measurements may be utilized to alert a driller, a controller, etc., to one or more deviations from a desired trajectory (e.g., a planned trajectory, etc.). To adjust for a deviation or to alter a trajectory, a drilling operation can switch from the rotating mode to the sliding mode. As mentioned, in the sliding mode, the drillstring is not rotated; rather, a downhole motor turns the bit and the borehole is drilled in the direction the bit is point, which is controlled by toolface orientation. Upon adjustment of course and reestablishing a desired trajectory that aims to hit a target (or targets), a drilling operation may transition from the sliding mode to the rotating mode, which, as mentioned, can be a combined surface and downhole rotating mode.

Of the two modes, slide drilling of the sliding mode tends to be less efficient; hence, lateral reach can come at the expense of penetration rate. The rate of penetration (ROP) achieved using a sliding technique tends to be approximately 10 percent to 25 percent of that attainable using a rotating technique.

Various types of automated systems (e.g., auto drillers) may aim to help a drilling operation to achieve gains in horizontal reach with noticeably faster rates of penetration.

When transitioning from the rotating mode to the sliding mode, a drilling operation can halt rotation of a drillstring and initiate a slide by orienting a bit to drill, for example, in alignment with a trajectory proposed in a well plan. As to halting rotation of a drillstring, consider, as an example, a drilling operation that pulls a bit off-bottom and reciprocates drillpipe to release torque that has built up within the drillstring. The drilling operation can then orient a downhole mud motor using real-time MWD toolface measurements to ensure the specified borehole deviation is obtained. Following this relatively time-consuming orientation process, the drilling operation can set a top drive brake to prevent further rotation from the surface. In such an example, a slide can begin as the drilling operation eases off a drawworks brake to control hook load, which, in turn, affects the magnitude of weight imposed at the bit (e.g., WOB). As an example, minor right and left torque adjustments (e.g., clockwise and counter-clockwise) may be applied manually to steer the bit as appropriate to keep the trajectory on course.

As the depth or lateral reach increases, a drillstring tends to be subjected to greater friction and drag. These forces, in turn, affect ability to transfer weight to the bit (e.g., WOB) and control toolface orientation while sliding, which may make it more difficult to attain sufficient ROP and maintain a desired trajectory to a target (or targets). Such issues can result in increased drilling time, which may adversely impact project economics and ultimately limit length of a lateral section of a borehole and hence a lateral section of a completed well (e.g., a producing well).

The capability to transfer weight to a bit affects several aspects of directional drilling. As an example, a drilling operation can transfers weight to a bit by easing, or slacking off, a brake, which can transfer some of the hook load, or drillstring weight, to the bit. The difference between the weight imposed at the bit and the amount of weight made available by easing the brake at the surface is primarily caused by drag. As a horizontal departure of a borehole increases, longitudinal drag of the drillpipe along the borehole tends to increase.

Controlling weight at the bit throughout the sliding mode can be made more difficult by drillstring elasticity, which permits the pipe to move nonproportionally. Such elasticity can cause one segment of drillstring to move while other segments remain stationary or move at different velocities. Conditions such as, for example, poor hole cleaning may also affect weight transfer. In the sliding mode, hole cleaning tends to be less efficient because of a lack of pipe rotation; noting that pipe rotation facilitates turbulent flow in the annulus between the pipe (drillstring pipe or stands) and the borehole and/or cased section(s). Poor hole cleaning is associated with ability to carry solids (e.g., crushed rock) in drilling fluid (e.g., mud). As solids accumulate on the low side of a borehole due to gravity, the cross-sectional area of the borehole can decrease and cause an increase in friction on a drillstring (e.g., pipe or stands), which can make it more difficult to maintain a desired weight on bit (WOB), which may be a desired constant WOB. As an example, poor hole cleaning may give rise to an increased risk of sticking (e.g., stuck pipe).

Differences in frictional forces between a drillstring inside of casing versus that in open hole can cause weight to be released suddenly, as can hang-ups caused by key seats and ledges. A sudden transfer of weight to the bit that exceeds a downhole motor's capacity may cause bit rotation to abruptly halt and the motor to stall. Frequent stalling can damage the stator component of a mud motor, depending on the amount of the weight transferred. A drilling operation can aim to operate a mud motor within a relatively narrow load range in an effort to maintain an acceptable ROP without stalling.

As an example, a system can include a console, which can include one or more displays that can render one or more graphical user interfaces (GUIs) that include data from one or more sensors. As an example, an impending stall might be indicated by an increase in WOB as rendered to a GUI, for example, with no corresponding upsurge in downhole pressure to signal that an increase in downhole WOB has actually occurred. In such an example, at some point, the WOB indicator may show an abrupt decrease, indicating a sudden transfer of force from the drillstring to the bit. Increases in drag impede an ability to remove torque downhole, making it more difficult to set and maintain toolface orientation.

Toolface orientation can be affected by torque and WOB. When weight is applied to the bit, torque at the bit tends to increase. As mentioned, torque can be transmitted downhole through a drillstring, which is operated generally for drilling by turning to the right, in a clockwise direction. As weight is applied to the bit, reactive torque, acting in the opposite direction, can develop. Such left-hand torque (counter-clockwise direction) can be transferred upward from the bit to the lower part of the drillstring. Reactive torque tends to build as weight is increased, for example, reaching its maximum value when a mud motor stalls. This reactive torque can also affects orientation of a mud motor. Reactive torque can be taken into account as a drilling operation tries to orient a mud motor from the surface. In practice, a drilling operation may act to make minor shifts in toolface orientation by changing downhole WOB, which alters the reactive torque. To produce larger changes, the drilling operation may act to lift a bit off-bottom and reorient the toolface. However, even after the specified toolface orientation is achieved, maintaining that orientation can be at times challenging. As mentioned, longitudinal drag tends to increases with lateral reach, and weight transfer to the bit can become more erratic along the length of a horizontal section, thus allowing reactive torque to build and consequently change the toolface angle. The effort and time spent on orienting the toolface can adversely impact productive time on the rig.

As explained, directional drilling can involve operating in the rotating mode and operating in the sliding mode where multiple transitions can be made between these two modes. As mentioned, drilling fluid can be utilized to drive a downhole mud motor and hence rotate a bit in a sliding mode while surface equipment can be utilized to rotate an entire drillstring in a rotating mode (e.g., a rotary table, a top drive, etc.), optionally in combination with drilling fluid being utilized to drive a downhole mud motor (e.g., a combined rotating mode). Directional drilling operations can depend on various factors, including operational parameters that can be at least to some extent controllable. For example, one or more factors such as mode transitions, lifting, WOB, RPM, torque, and drilling fluid flow rate can be controllable during a drilling operation.

Figure 7:
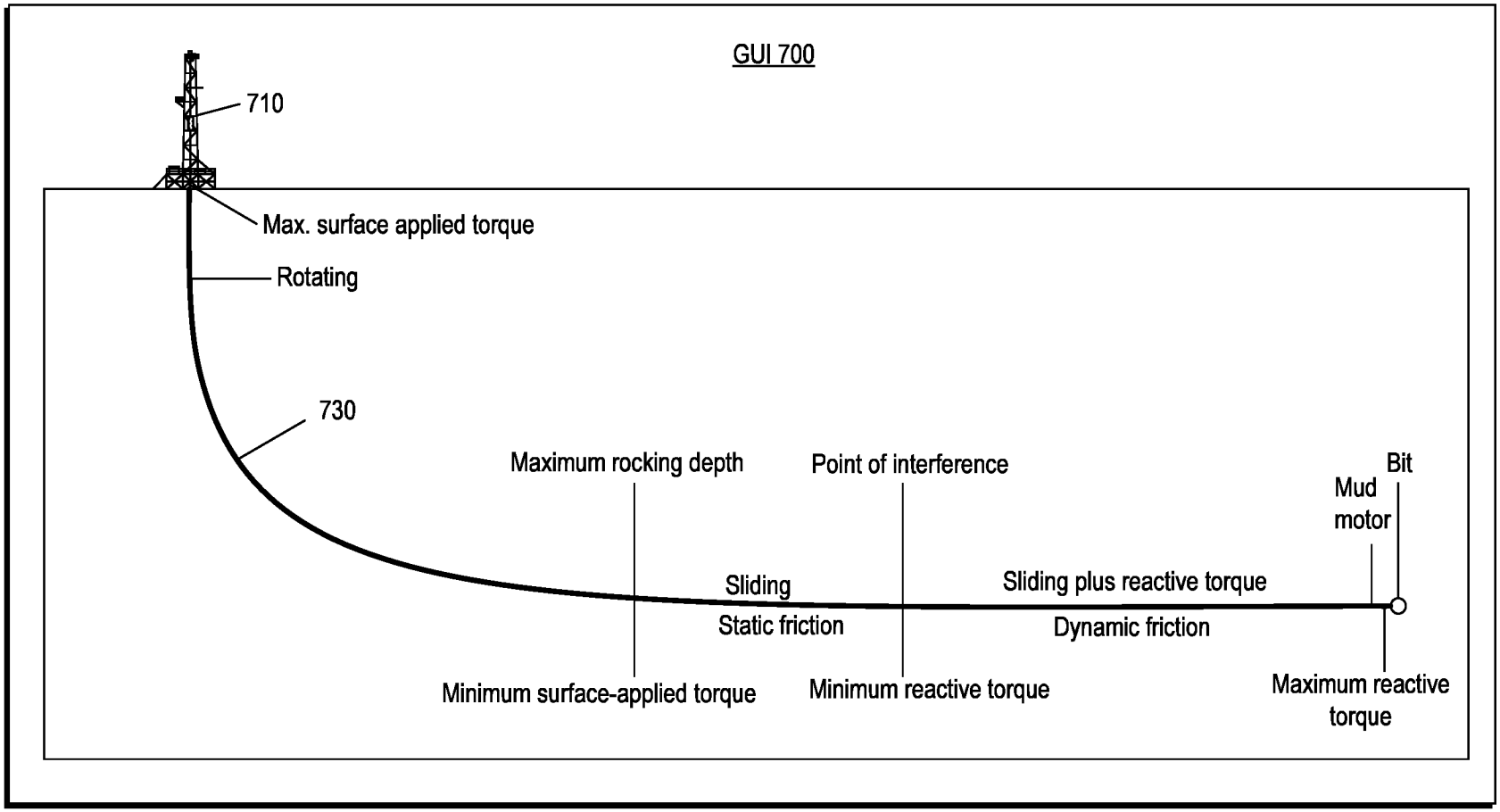
FIG. 7 illustrates an example of a graphical user interface.

FIG. 7 shows an example of a graphical user interface 700 that includes a graphic of a system 710 and a graphic of a trajectory 730 where the system 710 can perform directional drilling to drill a borehole according to the trajectory 730. As shown, the trajectory 730 includes a substantially vertical section, a dogleg and a substantially lateral section (e.g., a substantially horizontal section). The system 710 can be operated in various operational modes, which can include, for example, rotary drilling and sliding.

In the example of FIG. 7, longitudinal drag along the drillstring can be reduced from the surface down to a maximum rocking depth, at which friction and imposed torque are in balance. As an example, a drilling operation can include manipulating surface torque oscillations such that the maximum rock depth may be moved deep enough to produce a substantial reduction in drag. As an example, reactive torque from a bit can create vibrations that propagate back uphole, breaking friction and longitudinal drag across a bottom section of a drillstring up to a point of interference, where the torque is balanced by static friction. As shown in the example of FIG. 7, an intermediate zone may remain relatively unaffected by surface rocking torque or by reactive torque. In the example of FIG. 7, a drilling operation can include monitoring torque, WOB and ROP while sliding. As an example, such a drilling operation may aim to minimize length of the intermediate zone and thus reduces longitudinal drag.

A drilling operation in the sliding mode that involves manual adjustments to change and/or maintain a toolface orientation can be challenging. As an example, a drilling operation in the sliding mode can depend on an ability to transfer weight to a bit without stalling a mud motor and an ability to reduce longitudinal drag sufficiently to achieve and maintain a desired toolface angle. As an example, a drilling operation in the sliding mode can aim to achieve an acceptable ROP while taking into account one or more of various other factors (e.g., equipment capabilities, equipment condition, tripping, etc.).

In a drilling operation, as an example, amount of surface torque (e.g., STOR) supplied by a top drive can largely dictate how far downhole rocking motion can be transmitted. As an example, a relationship between torque and rocking depth can be modeled using a torque and drag framework (e.g., T&D framework). As an example, a system may include one or more T&D features.

As an example, a system may utilize inputs from surface hook load and standpipe pressure as well as downhole MWD toolface angle. In such an example, the system may automatically determine the amount of surface torque that is appropriate to transfer weight downhole to a bit, which may allow an operation to not come off-bottom to make a toolface adjustment, which can results in a more efficient drilling operation and reduced wear on downhole equipment. Such a system may be referred to as an automation assisted system.

Figure 8:
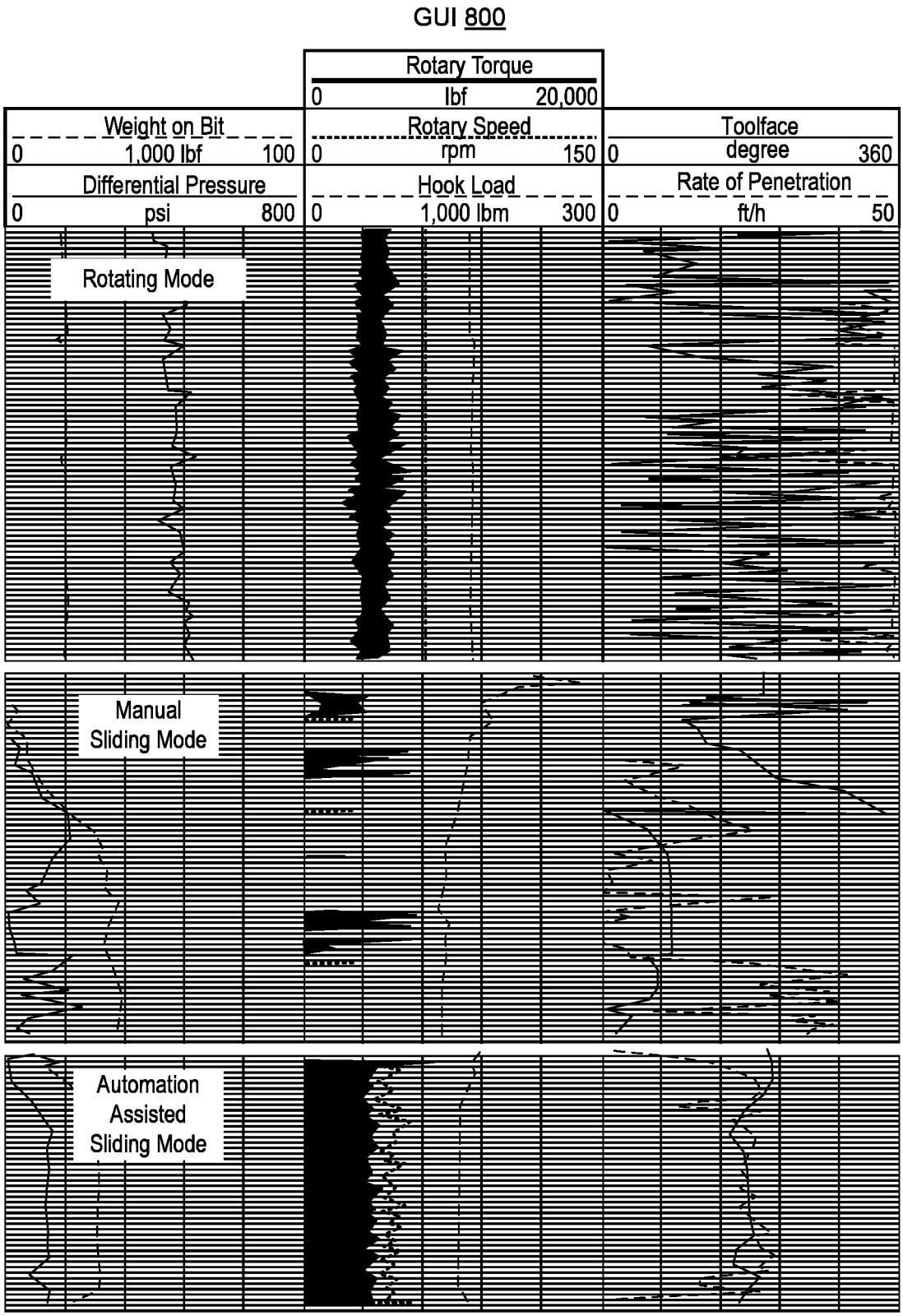
FIG. 8 illustrates an example of a graphical user interface.

FIG. 8 shows an example of a graphical user interface 800 that includes various tracks for different types of operations, which include rotating, manual sliding, and automation assisted sliding according to a provided amount of surface torque. As shown in the GUI 800, comparisons can be made for rotating and sliding drilling parameters for the rotating mode and the sliding mode. As shown, rate of penetration (ROP) and toolface orientation control can depend large on an ability of a system to transfer weight to the bit and counter the effects of torque and drag between rotating and sliding modes. As shown, the best ROP is achieved while rotating; however, toolface varies drastically, as there is no attempt to control it (Track 3). Hook load (Track 2) and weight on bit (WOB) remain fairly constant while differential pressure (Track 1) shows a slight increase as depth increases. To begin manual sliding, a drilling operation can act to pull off-bottom to release trapped torque; during this time, WOB (Track 1) decreases while hook load (Track 2) increases. As drilling proceeds, inconsistencies in differential pressure (e.g., difference between pressures when the bit is on-bottom versus off-bottom) indicate poor transfer of weight to the bit (Track 1). Spikes of rotary torque indicate efforts to orient and maintain toolface orientation (Track 2). As shown, toolface control may be poor because of trouble transferring weight to bit, which is also reflected by poor ROP (Track 3). Using an automation assisted sliding mode system, a directional driller can more quickly gain toolface orientation. When the WOB increased, differential pressure was consistent, demonstrating good weight transfer (Track 1). In the example of FIG. 8, weight on bit during a sliding operation is lower than during a manual sliding operation. Left-right oscillation of the drillpipe is relatively constant through the slide (Track 2). Average ROP is substantially higher than that attained during the manual slide, and toolface orientation is more consistent (Track 3).

FIG. 9 shows an example of a graphical user interface 900 that includes various types of information for construction of a well where times are rendered for corresponding actions. In the example of FIG. 9, the times are shown as an estimated time (ET) in hours and a total or cumulative time (TT), which is in days. Another time may be a clean time, which can be for performing an action or actions without occurrence of non-productive time (NPT) while the estimated time (ET) can include NPT, which may be determined using one or more databases, probabilistic analysis, etc. In the example of FIG. 9, the total time (TT or cumulative time) may be a sum of the estimated time column. As an example, during execution and/or replanning the GUI 900 may be rendered and revised accordingly to reflect changes. As shown in the example of FIG. 9, the GUI 900 can include selectable elements and/or highlightable elements. As an example, an element may be highlighted responsive to a signal that indicates that an activity is currently being performed, is staged, is to be revised, etc. For example, a color coding scheme may be utilized to convey information to a user via the GUI 900.

As an example, the GUI 900 can be operatively coupled to one or more systems that can assist and/or control one or more drilling operations. For example, consider the aforementioned automation assisted sliding mode system, which provides amounts of surface torque. As another example, consider a system that generates rate of penetration values, which may be, for example, rate of penetration set points. Such a system may be an automation assisted system and/or a control system. For example, a system may render a GUI that displays one or more generated rate of penetration values and/or a system may issue one or more commands to one or more pieces of equipment to cause operation thereof at a generated rate of penetration.

As an example, an automation assisted system may be utilized in one or more oil and gas drilling operations to improve drilling efficiency and consistency. As an example, when such a system is enabled, a controller can include various set points and limits for one or more drilling parameters, which can include, for example, differential pressure, rate of penetration (ROP), weight on bit (WOB), surface rotational speed (surface RPM), etc. In a bottom hole assembly with a mud motor as a drive, differential pressure can be utilized for control as a targeted drilling parameter. As an example, a system can provide for control of differential pressure to a desired set point and can facilitate keeping the differential pressure relatively constant until there is a change of the set point.

As an example, in an automation assisted system, if one of the drilling parameters reaches its set point or limit, one or more others may cease to track one or more corresponding set points and become reactive. As an example, if an ROP set point is too low such that ROP will reach the set point before differential pressure reaches its set point, then the drilling operation is not being performing at a level that can achieve its potential efficiency. On the other hand, if an ROP set point is too high, as the differential pressure reaches its set point, the ROP can reach its physical limit, for example, by bit design, which means the bit body has engaged with the formation to cause bit body wear.

As an example, a system can generate one or more rate of penetration values. For example, consider a system that can generate an ROP set point using various inputs. As an automation assisted system, one or more ROP set points can be generated and output, for example, to a GUI rendered to a display where, for example, a driller can assess one of the one or more ROP set points and take one or more actions that aim to achieve the one of the one or more ROP set points. As an example, a system may implement control by generating and utilizing one or more ROP set points where the system issues one or more signals to one or more pieces of equipment in an effort to achieve one of the one or more ROP set points.

As an example, a system can include an ROP set point generation engine (e.g., an ROP engine), which can be a computational engine, which may be part of a computational framework. As an example, an ROP engine can generate ROP set point recommendations based on a combined drilling system that includes a bit and a mud motor. In such an example, for each bit candidate, the ROP engine can utilize a bit engine (e.g., a bit static engine, etc.) to calculate a depth of cut (DOC) limit before a bit body engages with a formation; and, for each mud motor candidate, the ROP engine can utilize a mud motor engine that, based on a power section characteristic curve, accesses motor RPM with a designated differential pressure and flow rate. In such an example, the ROP engine can, by combining the bit DOC limit, and motor RPM, generate a recommended ROP set point for one or more different flow rates, one or more different surface RPMs and one or more differential pressures.

As an example, an ROP engine may be operable in one or more modes. For example, consider execution of an ROP engine in a planning phase to tabulate recommended ROP set points for different bit motor combinations and consider execution of an ROP engine in a drilling phase to recommend one or more ROP set points during one or more drilling operations where the ROP engine can generate one or more ROP set points in real-time (e.g., on the order of ten minutes or less).

As an example, for each bit, a table or other data structure of ROP versus RPM when a bit body comes into contact with a formation (e.g., engages a formation) can be pre-generated using a computational framework such as the IDEAS framework (Schlumberger Limited, Houston, Tex.). As an example, such a data structure can then be used to give an ROP set point automatically for one or more specific bit-motor combinations in planning phase or during a real-time drilling operation. As an example, an ROP engine can generate one or more ROP set points that can help to reduce risk of damage to a bit and/or actual damage to a bit. As an example, an ROP engine can smooth a drilling operation. As an example, a smoother drilling operation can be characterized as being less reactive while still achieving an acceptable ROP.

As mentioned, damaged equipment (e.g., a damaged mud motor, a damaged bit, etc.), can lead to tripping, which can cause an increase in non-productive time (NPT). As an example, an ROP engine can generate one or more ROP values that can smooth a drilling operation and reduce risk of having to make an unwanted trip. As an example, an ROP engine may be operatively coupled to a system that can generate output such as the data shown in the GUI 900 of FIG. 9. For example, consider a loop that can provide estimated times and total times based at least in part on one or more generated ROP values as may be associated with one or more bit and/or mud motor combinations. In such an example, a GUI may be rendered to a display with graphics for selection of one or more bits and/or one or more mud motors where upon selection of a bit and a mud motor, ROP values are generated that can be utilized to determine estimated times and/or total times. In such an example, a user may select a desired combination of bit and mud motor and ROP values, for example, to utilize as one or more ROP set points for drilling one or more sections (e.g., or a portion of one or more sections, etc.).

Figure 10:
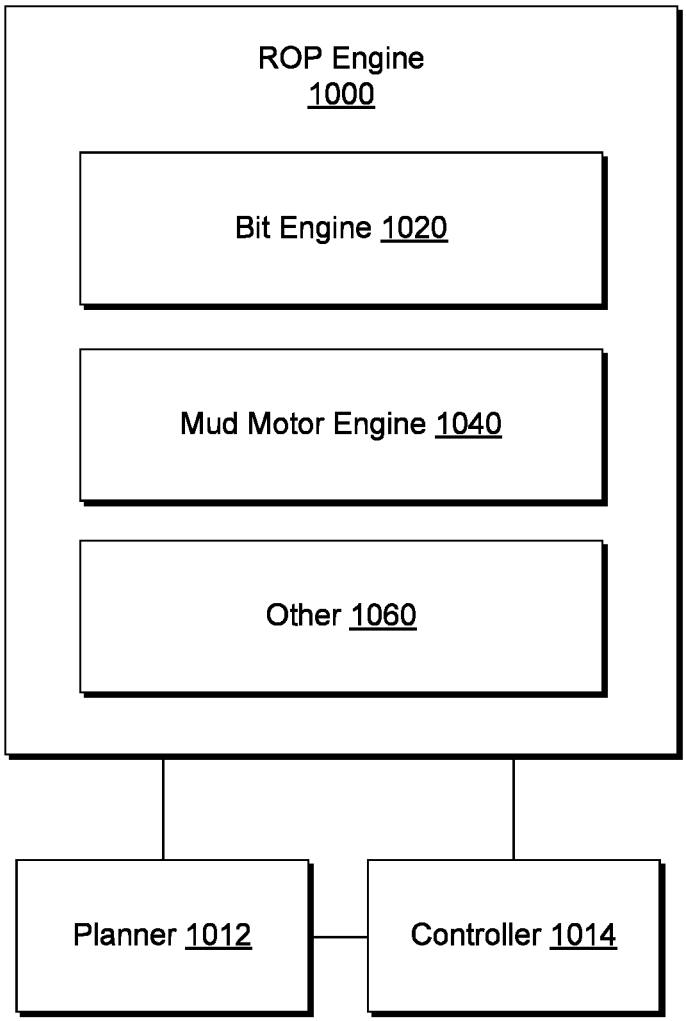
FIG. 10 illustrates an example of an rate of penetration engine.

FIG. 10 shows an example of a rate of penetration (ROP) engine 1000 operatively coupled to a planner 1012 and operatively coupled to a controller 1014 where the planner 1012 may be operatively coupled to the controller 1014. As an example, the ROP engine 1000, the planner 1012 and the controller 1014 may be separate, part of a common computational framework, or parts of one or more computational frameworks. As an example, one or more features of the ROP engine 1000 may be implemented using a system such as the system 470 of FIG. 4 and/or, for example, the system 470 may be operatively coupled to the ROP engine 1000. As an example, the controller 1014 of FIG. 10 may be part of the system 470 of FIG. 4. As an example, the ROP engine 1000 may be utilized in a system such as, for example, the system 300 of FIG. 3.

As shown in the example of FIG. 10, the ROP engine 1000 includes a bit engine 1020 and a mud motor engine 1040. As explained, the bit engine 1020 may provide bit-related information such as bit body engagement information with respect to a formation and the mud motor engine 1040 may provide mud motor information (e.g., RPM, etc.), for example, with respect to one or more operational parameters. As explained, the ROP engine 1000 can generate one or more ROP values that can, for example, be utilized for one or more purposes, which can include planning a drilling operation or drilling operations (e.g., for a particular well or wells) and performing a drilling operation or drilling operations (e.g., for a particular well or wells).

Figure 11:
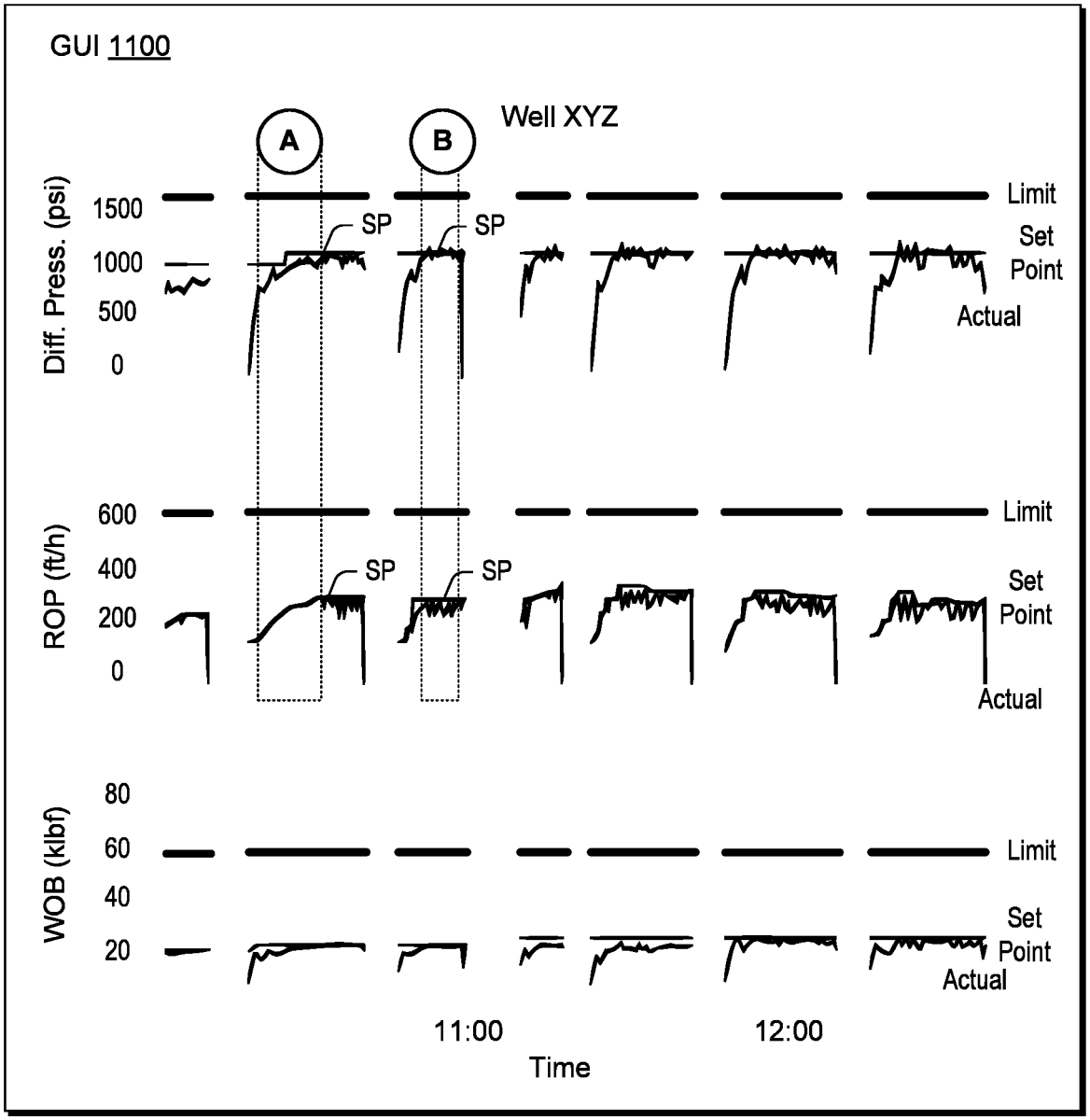
FIG. 11 illustrates an example of a graphical user interface.

FIG. 11 shows an example of a graphical user interface 1100 for a particular well that includes differential pressure (Diff. Press.), rate of penetration (ROP) and weight on bit (WOB) values with respect to time along with limits and set points.

The GUI 1100 can be operatively coupled to a framework such as a control framework that can be utilized to control one or more drilling operations. As shown, the GUI 1100 can include set points and limits for drilling parameters such as, for example, one or more of differential pressure, ROP, WOB and RPM.

As an example, a framework can push one or more drilling parameters to a respective set point and operate to maintain that set point constantly until a change of parameter command.

As an example, if one of the drilling parameters reaches its set point or limit, each of the other drilling parameter(s) can cease to track its set point and, for example, become reactive.

The GUI 1100 includes two examples of some possible scenarios, labeled A and B. As to scenario A, the ROP reached the set point (SP) while differential pressure was below its set point (SP); whereas, in scenario B, the differential pressured reached its set point (SP) while ROP did not reach its set point (SP) and became reactive (e.g., as long as it remained below its set point). As shown in the GUI 1100, for scenario B, the ROP versus time is choppy as it fluctuates by over 25 ft/h with respect to time (e.g., by approximately 10 percent). Such fluctuations represent changing behavior, which can be characterized as reactiveness, for example, reactiveness to conditions, ability to crush rock by a drill bit, ability of drilling fluid to maintain motor parameters (e.g., RPM, torque, etc.), etc.

As an example, an ROP engine can be utilized to generate one or more ROP values where for a particular depth range one of the one or more ROP values can be utilized to set a proper ROP set point or limit that can help to increase drilling efficiency, for example, while decreasing the risk of damaging a bit. As an example, an ROP engine can be part of a computational framework that can generate ROP set point and/or limit recommendations. In such an example, the recommendations can be for different bit-power section combinations at different differential pressure set points.

FIG. 12 shows an example of a bit 1210 that includes various cutting structures (e.g., cutters) that can be numbered from 1 to N and represented in a cross-sectional view, which is a view where cutter density and associated spatial information is illustrated by rotating the placement of the cutting structures onto a single radial plane. The bit 1210 may be, for example, a polycrystalline diamond compact (PDC) bit, which may be a fixed-head bit that rotates as one piece and that does not include separately moving parts.

As shown in FIG. 12, a bit can include blades 1212-1, 1212-2, . . . 1212-N, which may, for example, include primary blades and secondary blades. As an example, blades can part of a bit body and hence integral thereto. As shown, a blade can include a blade top for mounting a plurality of cutting structures (e.g., as numbered from 1 to N). As an example, a cutting structure can include a cutting face where the cutting structure is mounted in a pocket formed in a blade top. Cutting structures can be arranged adjacent one another in a radially extending row proximal the leading edge of a blade. As an example, a cutting face can have an outermost cutting tip that can be furthest from the blade top to which the cutting structure is mounted. As shown in FIG. 12, a bit body can include various passages that can allow for drilling fluid to flow between and both clean and cool the blades 1212-1, 1212-2, . . . , 1212-N during drilling. As an example, a bit can be defined by a bit centerline and a bit face where blades extend radially along the bit face. As shown in FIG. 12, each of the blades 1212-1, 1212-2, . . . , 1212-N can extend a distance outwardly such that channels are defined between adjacent blades. As mentioned, each blade includes a blade top, which may be defined by a blade height parameter. As mentioned, cutting structures can be mounted to blades where drilling is to utilize the cutting structures to "cut" rock. As an example, a cutting structure can extend outwardly beyond a blade top to which it is mounted. Cutting structures (e.g., cutting elements) can be, for example, PDC cutting structures such that a bit can be referred to as a PDC bit. Forming PDC into useful shapes for cutting structures can involve placing diamond grit, together with its substrate, in a pressure vessel and then sintering at high heat and pressure. As an example, a bit body may be considered to be a carrier for cutting structures.

As an example, a bit may be a matrix body bit (MBB) or a steel body bit (SBB). A matrix can be hard yet somewhat brittle composite material that can include tungsten carbide grains metallurgically bonded with a softer, tougher, metallic binder. A matrix can be desirable as a bit material as its hardness can provide resistance to abrasion and erosion. A matrix bit may be capable of withstanding relatively high compressive loads, but, compared with steel, may have a relatively low resistance to impact loading.

As a matrix can be relatively heterogeneous, because it is a composite material, and, because of the size and placement of particles of tungsten carbide, a matrix can vary (e.g., by both design and circumstances) such that its physical properties may be less predictable than steel.

Matrix body bits can be manufactured by a mold process. For example, tungsten carbide and binder materials can be arranged into a mold that is then placed in a furnace for a certain period of the time. The mold can then be cooled down and released to remove the unfinished matrix bit.

As to a steel body, it can be capable of withstanding high impact loads, but can be relatively soft and, without protective features, would tend to fail quickly by abrasion and erosion. Quality steels tend to be homogeneous with structural limits that tend to be predictable. A steel body may be manufactured by machining steel bars per design.

Design characteristics and manufacturing processes for different bit types are, in respect to body construction, different, because of the nature of the materials from which they are made. The lower impact toughness of matrix limits some matrix-bit features, such as blade height. Conversely, steel is ductile, tough, and capable of withstanding greater impact loads. This makes it possible for steel body PDC bits to be relatively larger than matrix bits and to incorporate greater height into features such as blades.

Matrix body PDC bits tend to be suitable for environments in which body erosion is likely to cause a bit to fail. For diamond-impregnated bits, matrix-body construction can be used. The strength and ductility of steel give steel bit bodies high resistance to impact loading. Steel bodies tend to be stronger than matrix bodies. Because of steel material capabilities, complex bit profiles and hydraulic designs can be possible to construct on a multi-axis, computer-numerically-controlled milling machine. A steel bit may be amenable to being rebuilt a number of times where worn or damaged cutters can be replaced, which can be beneficial for operators in low-cost drilling environments.

Cutting structures or cutters of a bit may be expected to endure throughout the life of a bit. To perform suitably, cutters can receive both structural support and efficient orientation from bit body features. Cutter orientation can be such that cutters are loaded by to a large extent (e.g., primarily) by compressive forces during operation. To prevent loss (e.g., detachment from a body), cutters can be retained, for example, by braze material that has adequate structural capabilities and has been properly deposited during manufacturing.

Cutters can be appropriately placed on a bit face (e.g., mounted on blades) in an effort to ensure a desired amount of bottomhole coverage (e.g., complete bottomhole coverage). The term "cutter density" refers in part to the number of cutters used in a particular bit design. For example, PDC bit cutter density can be a function of profile shape and length and of cutter size, type, and quantity. If there is a redundancy of cutters, the redundancy can generally increase from the center of the bit to the outer radii because of increasing demands for work as radial distance from the bit centerline increases. Cutters nearer to the gauge travel farther and faster and remove more rock than cutters near the centerline. As shown in FIG. 12, cutter density can be illustrated by rotating each cutter's placement onto a single radial plane. Such an illustration may be referred to as a planar representation of cutter density, which is shown to increase with radial position.

Reducing the number of cutters on a bit face tends to yield the following results: depth of cut (DOC) increases; ROP increases; torque increases; and bit life is shortened; whereas, increasing cutter density tends to yield: a decrease in ROP; a decrease in cutting structure cleaning efficiency; and an increase in bit life.

In the examples of FIG. 12, cutter density is increased in the outward radial direction from the bit centerline for the bit depicted where a planar cutter strike pattern inscribes an image of a bit profile.

In FIG. 12, a computer-aided design (CAD) representation of a bit is shown along with a planar representation of cutter density 1225, where a blade top 1226, a cutting structure 1227 (e.g., a cutter) and an example of an optional feature 1228 is shown as being disposed on the blade top 1226 (e.g., noting that a bit may include a plurality of such features). As an example, a CAD file may be generated and utilized to determine one or more factors that can be germane to one or more drilling operations. For example, a CAD representation of a bit can be utilized to determine when a bit body may engage a formation. As mentioned, if an ROP set point is too high, as differential pressure reaches its set point, actual ROP can reach a physical limit by bit design, which can be characterized by a bit body engaging a formation to cause bit body wear. As mentioned, the ROP engine 1000 can include the bit engine 1020 that can calculate the depth of cut (DOC) limit (e.g., a maximum DOC value) before a bit body engages with a formation. As an example, a maximum DOC value may be a maximum desired DOC value, for example, defined in part by undesirable, detrimental contact between a formation and one or more portions of a bit body (e.g., a blade top, blade tops, etc.). As mentioned, a data structure can include information for a plurality of bits organized with respect to ROP and RPM as to when a bit body will come into contact with a formation (e.g., or different types of formations). As mentioned, a framework such as the IDEAS framework may be utilized to generate such a data structure or a portion thereof.

As an example, a method can include design or selection of a bit by running an IDEAS platform dynamics simulation (Schlumberger Limited, Houston, Tex.), which allows for comparing options by looking at ROP performance versus shock and vibration. For a mud motor BHA, simulation results for a bit will be affected by the behavior of the mud motor. As an example, a framework can utilize one or more downhole power curves (e.g., from motor modeling, etc.) to output bit/motor combination results (e.g., for performance, stability, etc.).

The IDEAS integrated dynamic design and analysis platform provides 4D, time-based simulations that capture a drillstring and wellbore geometry for modeling of cutting interface designs for drilling rock and milling metal applications. The IDEAS dynamic modeling platform includes a suite of solid mechanics and programs that enable modeling bit-to-rock and mill-to-metal interactions in a virtual environment to customize material design in real time. The IDEAS platform can use theoretical calculations, numerical packages (e.g., finite element, etc.), in-house drill rig tests, full-scale rig tests, and field tests with MWD or downhole drilling dynamics sensors.

Figure 13:
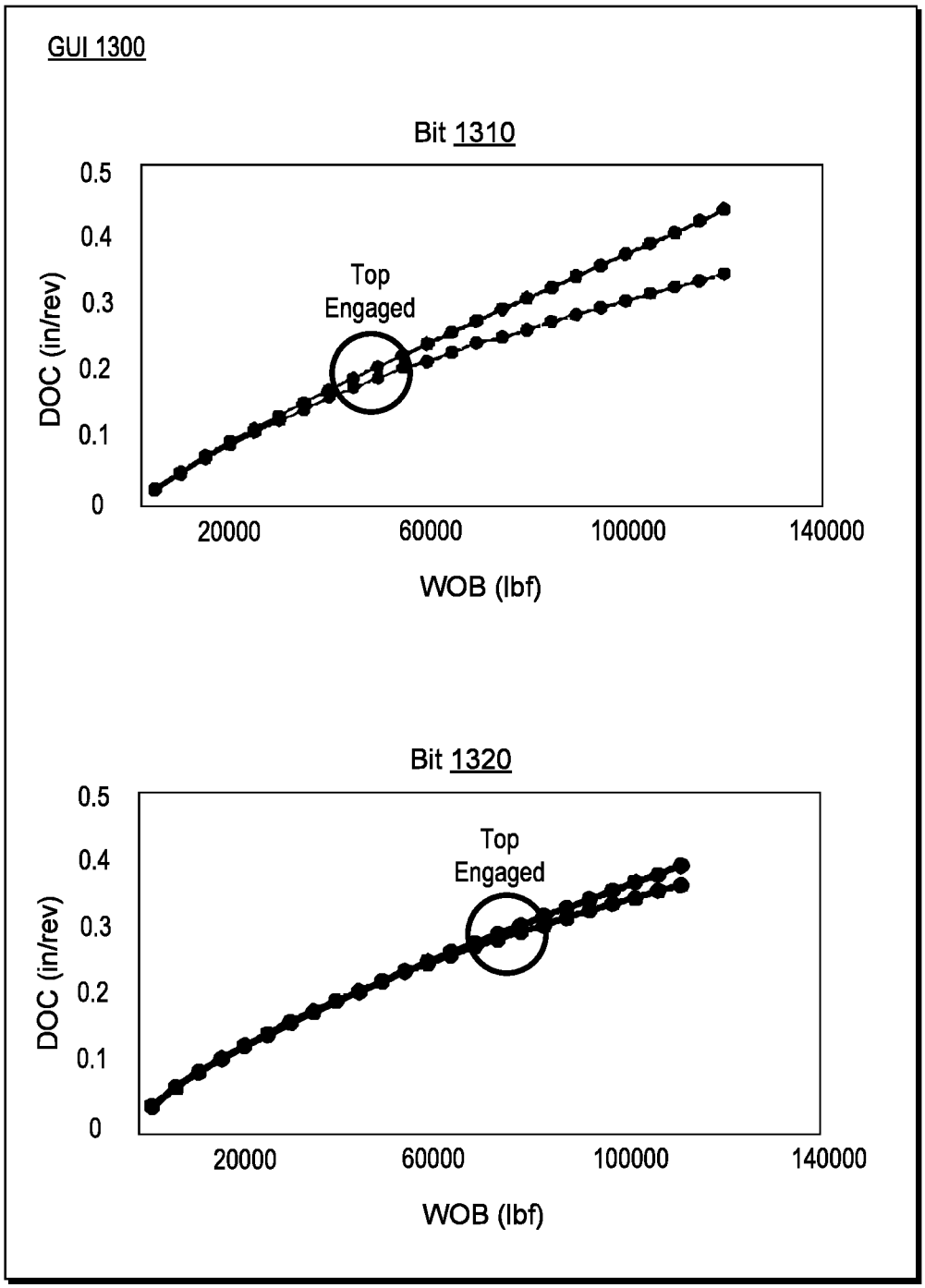
FIG. 13 illustrates an example of a graphical user interface.

FIG. 13 shows an example of a graphical user interface 1300 that includes example plots 1310 and 1320 for depth of cut (DOC) and weight on bit (WOB) for two different bits. Each of the plots 1310 and 1320 includes a circle that indicates where a top of the bit engages a formation. As shown in FIG. 13, the engagement corresponds to a depth of cut (DOC) value (e.g., or range) and a weight on bit (WOB) value (e.g., or range). As indicated in the plots 1310 and 1320, the depth of cut (DOC) value is given as a distance per revolution. As an example, a rate of penetration (ROP) may be determined by multiplying the depth of cut (DOC) of a bit in distance per revolution by a revolution rate of a bit, which may be in revolutions per unit time. For example, where DOC is in inches per revolution and bit rotation is in revolutions per minute (RPM), an ROP may be determined by multiplying the DOC by the RPM to arrive at a ROP in inches per minute. Such a value may be in various units, for example, FIG. 19 shows a ROP value of 150.12 feet per hour that is utilized for normalizing various ROP values. A ROP value may be given in distance per unit time (e.g., feet per hour, meters per hour, etc.). As an example, such plots may be generated using a framework such as, for example, the IDEAS framework.

As an example, a method can include determining the maximum depth of cut (DOC), which is per revolution, when a bit blade top starts to engage a formation; from a differential pressure set point, determining a motor revolution rate (e.g., RPM, etc.); determining a total bit revolution rate (e.g., which may be for motor RPM and surface RPM, etc.); and determining a rate of penetration (ROP) set limit by multiplying the depth of cut (DOC) with the total revolution rate (e.g., RPM, etc.). Such a method can help to reduce risk of a bit blade top contacting a formation due to an inappropriate ROP limit setting. As explained, such contacting can result in damage to a bit, which may result in performance of one or more operations that can introduce non-productive time (e.g., tripping out to replace a bit, replacement of the bit, tripping in, etc.). As mentioned, there can be various impetuses to drill fast (e.g., high ROP) to complete a well and start producing fluid from the well. However, drilling fast without sufficient insight can result in issues such as bit damage. A method that provides ROP limit settings can be viewed as providing guidance, particularly where such ROP limit settings help to reduce risk of one or more issues while still aiming to drill efficiently such that a well can be completed and brought on-line to produce fluid in a timely manner.

In the plots 1310 and 1320 of FIG. 13, weight on bit (WOB) is utilized as a parameter to facilitate determining the maximum DOC for a given bit where, for example, computationally, DOC increases with respect to WOB. As shown, the maximum DOC for a given bit is a defined value according to a condition (see, e.g., "top engaged") that can be determined using two types of computations for the given bit. As explained, rigsite equipment can include a weight indicator that is operatively coupled to a sensor where the weight indicator can provide readings that can be utilized to determine WOB. As mentioned, DOC can increase with WOB, however, at some point, depending on various factors, a portion or portions of a bit may contact a formation (e.g., rock) in a manner that is detrimental to the bit (e.g., to the body of the bit). Such detrimental contact can result in damage, which may result in a premature changing of the bit (e.g., via tripping out, changing the bit, and tripping in).

As an example, readings from a weight indicator can be utilized to monitor and improve operating efficiencies of a drilling operation. As an example, a weight indicator can be operatively coupled to a hydraulic gauge (e.g., a hydraulic sensor) attached to a dead line of a drilling line. In such an example, as tension increases in the drilling line, more hydraulic fluid is forced through the hydraulic gauge, which can cause turning of a hand (or hands) of the weight indicator (e.g., hands of a dial, etc.). As an example, an indicator and/or a sensor can include digital circuitry, for example, with digital data output. During drilling operations, the weight that is measured can include various masses exerting tension on the wire rope, including the traveling blocks and cable itself. Hence, to have an accurate weight measurement of the drillstring, a driller can first make a zero offset adjustment to account for the traveling blocks and items other than the drillstring. Then the indicated weight will more accurately represent the drillstring (e.g., drillpipe and bottomhole assembly). During drilling operations, however, the weight of interest is the weight applied to the bit on the bottom of the hole. As an example, a driller may take a rotating and hanging off bottom weight (e.g., 300,000 lbf or 136,200 kgf), and subtract from that the amount of rotating on bottom weight (e.g., 250,000 lbf or 113,500 kgf), to get a bit weight (e.g., 50,000 lbf or 22,700 kgf). Various rigs can be equipped with a weight indicator that has a second indicator dial that can be set to read zero ("zeroed") with the drillstring hanging free, and works backwards from the main indicator dial. After proper zeroing, weight set on bottom (e.g., that takes weight away from the main dial), has the effect of adding weight to this secondary dial, so that the driller can read weight on bit (WOB) directly from the dial.

Referring again to the plots 1310 and 1320 of FIG. 13, a method can include performing an IDEAS framework bit analysis by applying different WOB values. In each of the plots 1310 and 1320, two sets of data are presented where data in each set are for the same bit design; however, one curve is for data with the blade top in the model while the other curve is for data without the blade top in the model. In such an approach, when there is a difference in DOC under the same WOB, it is possible to determine that the blade top has come into contact with formation to generate the difference in DOC (e.g., a DOC difference). In such an approach, by simulating drilling of different rock (e.g., different formation types, etc.), the WOB that causes the blade top to contact the rock can differ. As an example, a method can include determining the maximum DOC value when contact occurs (e.g., via a difference in computed DOC values as shown in FIG. 13). As an example, a method may or may not utilize a corresponding WOB number itself.

As explained with respect to FIG. 12, a blade top may have one or more different types of geometric features (see, e.g., the feature 1228 in FIG. 12). For example, consider a type of button shaped tungsten carbide extrusion. As an example, a bit may include one or more of such extrusions that can act to avoid excessive DOC, for example, when one or more WOB spikes may occur due to bit bouncing, etc. Such features may contact a formation top when DOC is quite small. As an example, a method can include performing an IDEAS framework analysis (e.g., or other analysis of DOC and WOB, etc.) where such contact can be allowed to occur (e.g., be acceptable). In such an example, a method may utilize a certain threshold on a DOC difference between the two curves for determining the maximum DOC point where blade top contact is effectively occurring. In the plots 1310 and 1320, the threshold can be seen in the circled regions where the two curves in each of the plots 1310 and 1320 deviate (e.g., by a certain amount). As an example, a derivative type of analysis (e.g., slope) may be utilized and/or models may be utilized (e.g., linear, non-linear, etc.) where one or more model parameters can be analyzed for a difference that can be indicative of a maximum DOC for a particular bit.

As mentioned, the ROP engine 1000 of FIG. 10 can include the mud motor engine 1040 as a computational engine for generating data for a particular mud motor. As mentioned, the ROP engine 1000 of FIG. 10 can utilize the mud motor engine 1040 and the bit engine 1020 for generating one or more ROP values.

Figure 14:
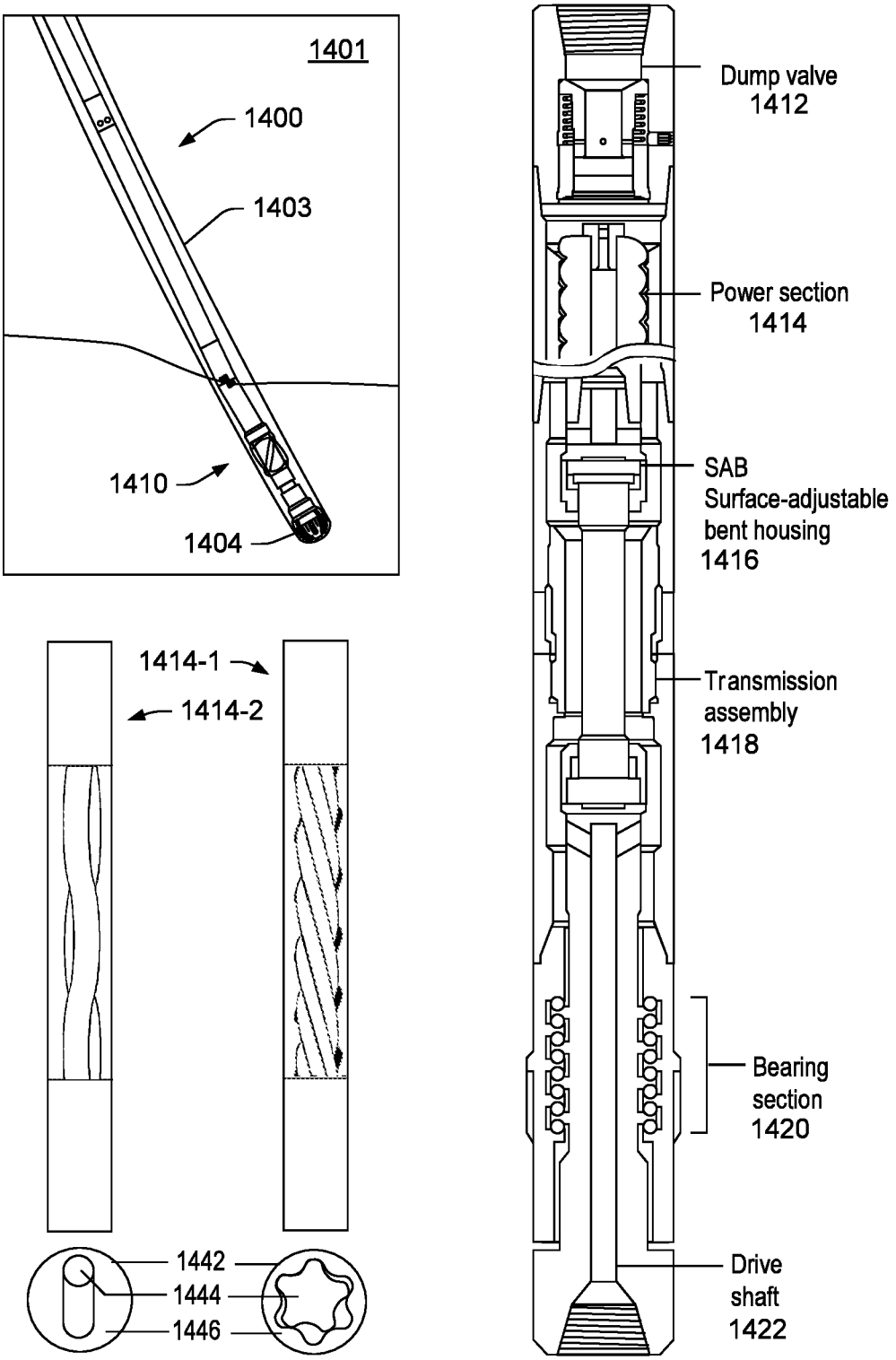
FIG. 14 illustrates an example of a drillstring in a geologic environment and examples of mud motor equipment.

FIG. 14 shows an example of a drilling assembly 1400 in a geologic environment 1401 that includes a borehole 1403 where the drilling assembly 1400 (e.g., a drillstring) includes a bit 1404 and a motor section 1410 where the motor section 1410 includes a mud motor that can drive the bit 1404 (e.g., cause the bit 1404 to rotate and deepen the borehole 1403).

As shown, the motor section 1410 includes a dump valve 1412, a power section 1414, a surface-adjustable bent housing 1416, a transmission assembly 1418, a bearing section 1420 and a drive shaft 1422, which can be operatively coupled to a bit such as the bit 1404. Flow of drilling fluid through the power section 1414 can generate power that can rotate the drive shaft 1422, which can rotate the bit 1404.

As to the power section 1414, two examples are illustrated as a power section 1414-1 and a power section 1414-2 each of which includes a housing 1442, a rotor 1444 and a stator 1446. The rotor 1444 and the stator 1446 can be characterized by a ratio. For example, the power section 1414-1 can be a 5:6 ratio and the power section 1414-2 can be a 1:2 ratio, which, as seen in cross-sectional views, can involve lobes (e.g., a rotor/stator lobe configuration). The motor section 1410 of FIG. 14 may be a POWERPAK family motor section (Schlumberger Limited, Houston, Tex.) or another type of motor section. The POWERPAK family of motor sections can include ratios of 1:2, 2:3, 3:4, 4:5, 5:6 and 7:8 with corresponding lobe configurations.

A power section can convert hydraulic energy from drilling fluid into mechanical power to turn a bit. For example, consider the reverse application of the Moineau pump principle. During operation, drilling fluid can be pumped into a power section at a pressure that causes the rotor to rotate within the stator where the rotational force is transmitted through a transmission shaft and drive shaft to a bit.

A motor section may be manufactured in part of corrosion-resistant stainless steel where a thin layer of chrome plating may be present to reduce friction and abrasion. As an example, tungsten carbide may be utilized to coat a rotor, for example, to reduce abrasion wear and corrosion damage. As to a stator, it can be formed of a steel tube, which may be a housing (see, e.g., the housing 1442) with an elastomeric material that lines the bore of the steel tube to define a stator. An elastomeric material may be referred to as a liner or, when assembled with the tube or housing, may be referred to as a stator. As an example, an elastomeric material may be molded into the bore of a tube. An elastomeric material can be formulated to resist abrasion and hydrocarbon induced deterioration. Various types of elastomeric materials may be utilized in a power section and some may be proprietary. Properties of an elastomeric material can be tailored for particular types of operations, which may consider factors such as temperature, speed, rotor type, type of drilling fluid, etc. Rotors and stators can be characterized by helical profiles, for example, by spirals and/or lobes. A rotor can have one less fewer spiral or lobe than a stator (see, e.g., the cross-sectional views in FIG. 14).

During operation, the rotor and stator can form a continuous seal at their contact points along a straight line, which produces a number of independent cavities. As fluid is forced through these progressive cavities, it causes the rotor to rotate inside the stator. The movement of the rotor inside the stator is referred to as nutation. For each nutation cycle, the rotor rotates by a distance of one lobe width. The rotor nutates each lobe in the stator to complete one revolution of the bit box. For example, a motor section with a 7:8 rotor/stator lobe configuration and a speed of 100 RPM at the bit box will have a nutation speed of 700 cycles per minute. Generally, torque output increases with the number of lobes, which corresponds to a slower speed. Torque also depends on the number of stages where a stage is a complete spiral of a stator helix. Power is defined as speed times torque; however, a greater number of lobes in a motor does not necessarily mean that the motor produces more power. Motors with more lobes tend to be less efficient because the seal area between the rotor and the stator increases with the number of lobes.

The difference between the size of a rotor mean diameter (e.g., valley to lobe peak measurement) and the stator minor diameter (lobe peak to lobe peak) is defined as the rotor/stator interference fit. Various motors are assembled with a rotor sized to be larger than a stator internal bore under planned downhole conditions, which can produce a strong positive interference seal that is referred to as a positive fit. Where higher downhole temperatures are expected, a positive fit can be reduced during motor assembly to allow for swelling of an elastomeric material that forms the stator (e.g., stator liner). Mud weight and vertical depth can be considered as they can influence the hydrostatic pressure on the stator liner. A computational framework such as, for example, the POWERFIT framework (Schlumberger Limited, Houston, Tex.), may be utilized to calculate a desired interference fit.

As to some examples of elastomeric materials, consider nitrile rubber, which tends to be rated to approximately 138 C (280 F), and highly saturated nitrile, which may be formulated to resist chemical attack and be rated to approximately 177 C (350 F).

The spiral stage length of a stator is defined as the axial length for one lobe in the stator to rotate 360 degrees along its helical path around the body of the stator. The stage length of a rotor differs from that of a stator as a rotor has a shorter stage length than its corresponding stator. More stages can increase the number of fluid cavities in a power section, which can result in a greater total pressure drop. Under the same differential pressure conditions, the power section with more stages tends to maintain speed better as there tends to be less pressure drop per stage and hence less leakage.

Drilling fluid temperature, which may be referred to as mud temperature or mud fluid temperature, can be a factor in determining an amount of interference in assembling a stator and a rotor of a power section. As to interference, greater interference can result in a stator experiencing higher shearing stresses, which can cause fatigue damage. Fatigue can lead to premature chunking failure of a stator liner. As an example, chlorides or other such halides may cause damage to a power section. For example, such halides may damage a rotor through corrosion where a rough edged rotor can cut into a stator liner (e.g., cutting the top off an elastomeric liner). Such cuts can reduce effectiveness of a rotor/stator seal and may cause a motor to stall (e.g., chunking the stator) at a low differential pressure. For oil-based mud (OBM) with supersaturated water phases and for salt muds, a coated rotor can be beneficial.

As to differential pressure, as mentioned, it is defined as the difference between the on-bottom and off-bottom drilling pressure, which is generated by the rotor/stator section (power section) of a motor. As mentioned, for a larger pressure difference, there tends to be higher torque output and lower shaft speed. A motor that is run with differential pressures greater than recommended can be more prone to premature chunking. Such chunking may follow a spiral path or be uniform through the stator liner. A life of a power section can depend on factors that can lead to chunking (e.g., damage to a stator), which may depend on characteristics of a rotor (e.g., surface characteristics, etc.).

As to trajectory of a wellbore to be drilled, it can be defined in part by one or more dogleg seventies (DLSs). Rotating a motor in high DLS interval of a well can increase risk of damage to a stator. For example, the geometry of a wellbore can cause a motor section to bend and flex. A power section stator can be relatively more flexible that other parts of a motor. Where the stator housing bends, the elastomeric liner can be biased or pushed upon by the housing, which can result in force being applied by the elastomeric liner to the rotor. Such force can lead to excessive compression on the stator lobes and cause chunking.

A motor can have a power curve. A test can be performed using a dynamo meter in a laboratory, for example, using water at room temperature to determine a relationship between input, which is flow rate and differential pressure, to power output, in the form of RPM and torque. Such information can be available in a motor handbook. However, what is actually happening downhole can differ due to various factors. For example, due to effect of downhole pressure and temperature, output can be reduced (e.g., the motor power output). Such a reduction may lead one to conclude that a motor is not performing. In response, a driller may keep pushing such that the pressure becomes too high, which can damage elastomeric material due to stalling (e.g., damage a stator).

Figure 15:
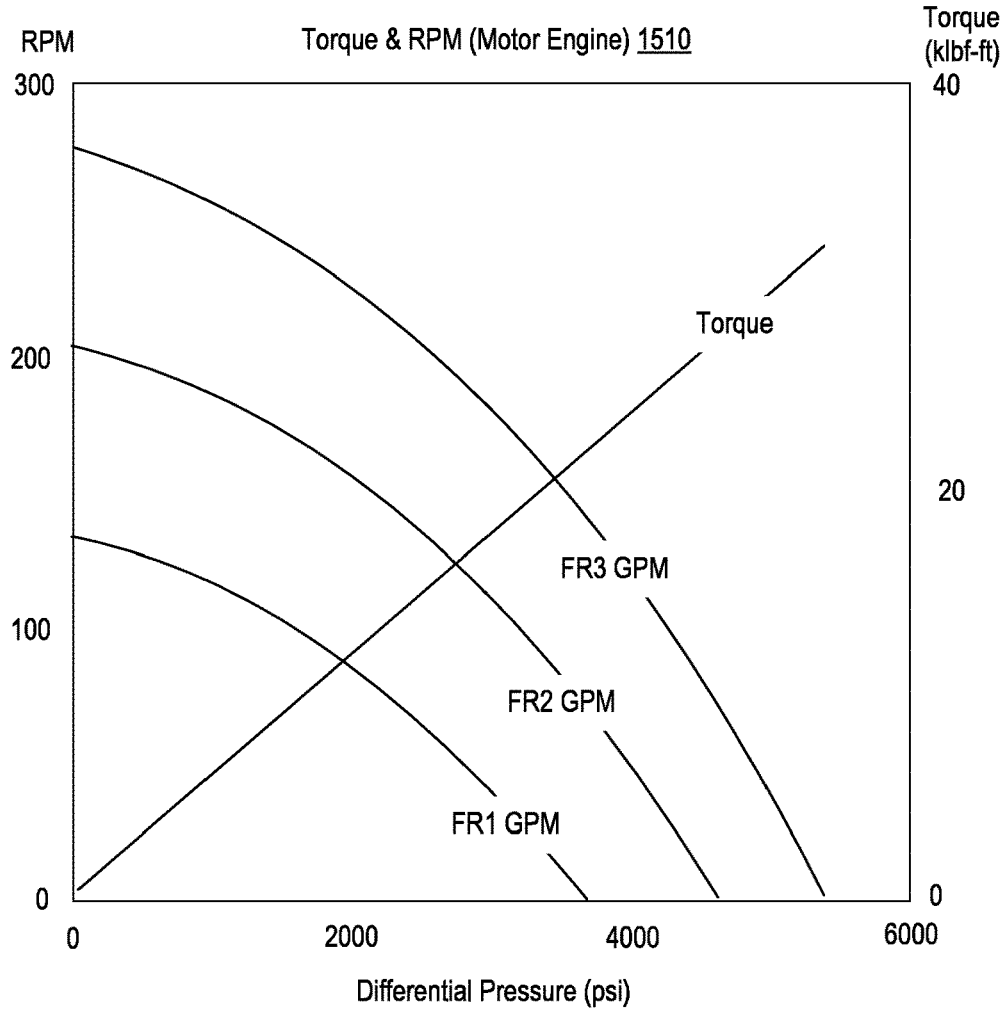
FIG. 15 illustrates an example of a graphical user interface.

FIG. 15 shows an example of a graphical user interface 1500 of a computational framework that can generate mud motor data such as the data illustrated in a plot 1510 of RPM and torque versus differential pressure. As shown in FIG. 15, the GUI 1500 can include various fields for input of parameters of a mud motor (e.g., eccentricity, maximum flow rate, minimum flow rate, stator major diameter, rotor major diameter, rotor minor diameter, number of lobes, number of stator stages, etc.) and can include various fields for input of model parameters (e.g., power section type, elastomer type, fit profile type, fit adjustment, mud density, mud temperature, reference temperature, hydraulic pressure, etc.).

Figure 16:
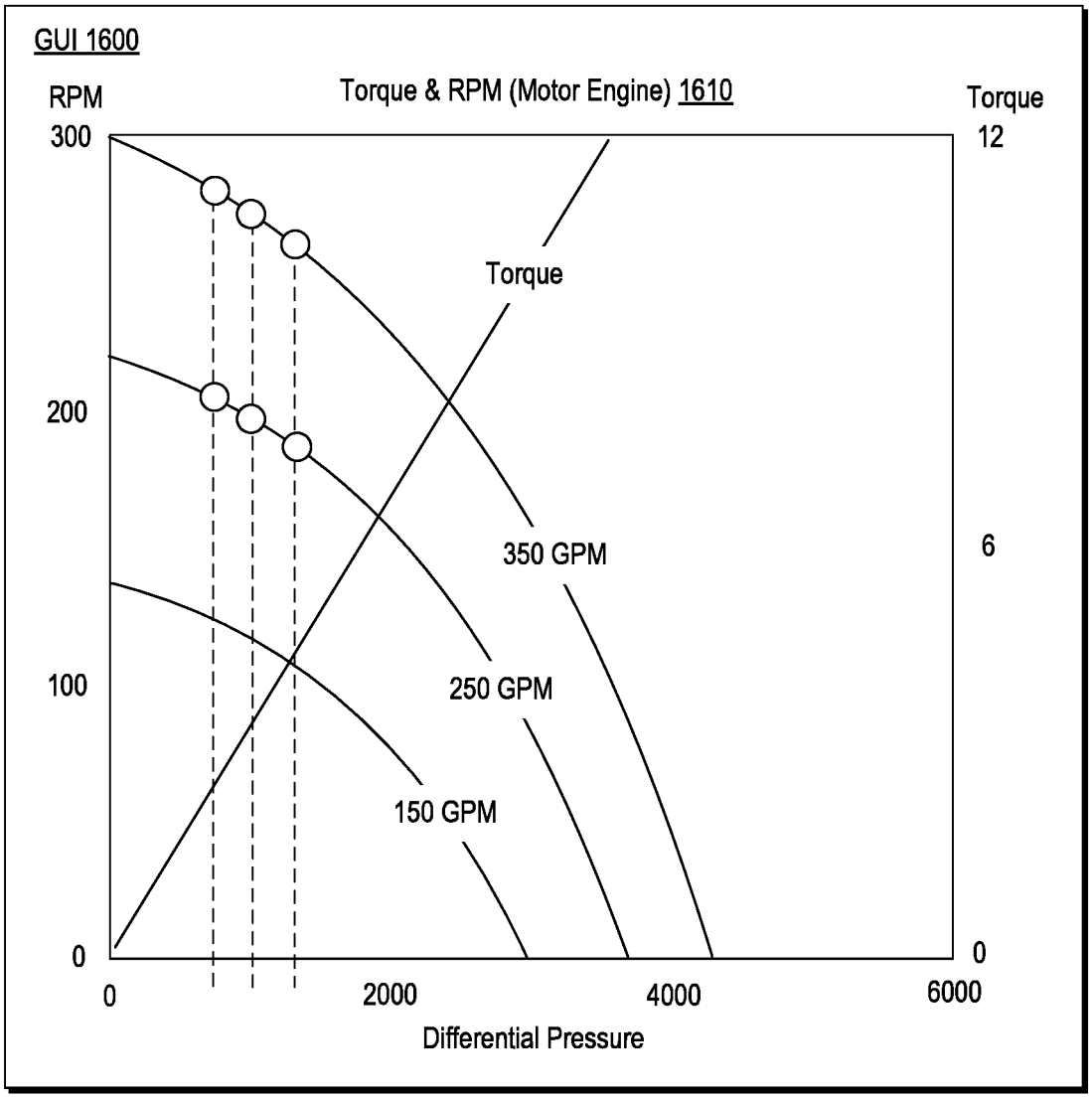
FIG. 16 illustrates an example of a graphical user interface.

FIG. 16 shows an example plot 1610 of a mud motor with a 6/7 power section and 8.0 stages. In the plot 1610, various points are illustrated, which may be considered for one or more drilling operations. Specifically, in the example of FIG. 16, the plot 1610 includes points as follows: $\Delta P$ of 800, 1000, and 1200 psi; flow rate of 250 and 350 GPM; and SRPM 40, 60, and 80.

Figure 17:
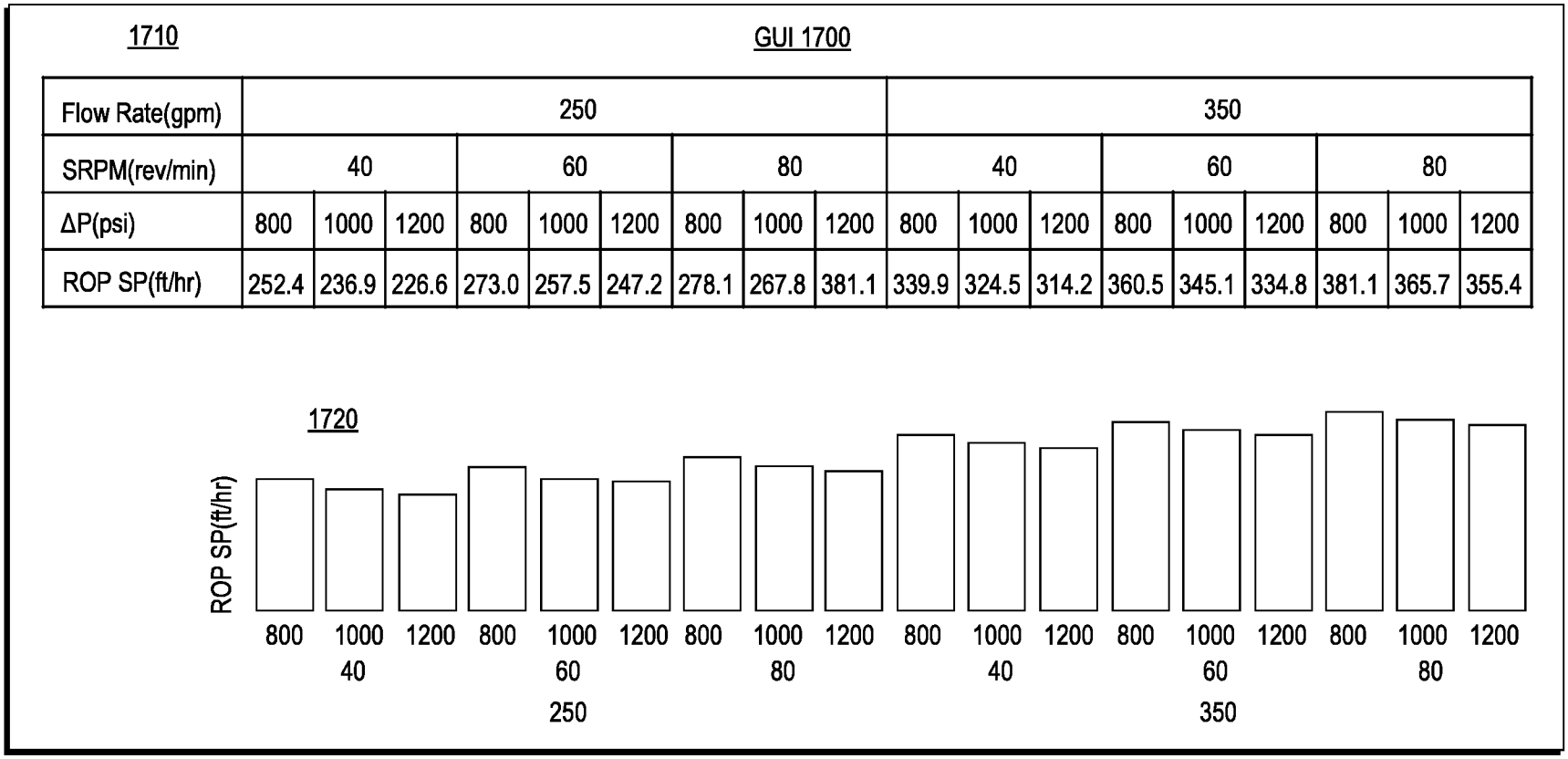
FIG. 17 illustrates an example of a graphical user interface.

FIG. 17 shows an example of a graphical user interface 1700 that includes an example table 1710 and an example plot 1720 of values for flow rate, SRPM (surface RPM provided by surface equipment), differential pressure and ROP set points for a combination of a bit and a mud motor.

Figure 18:
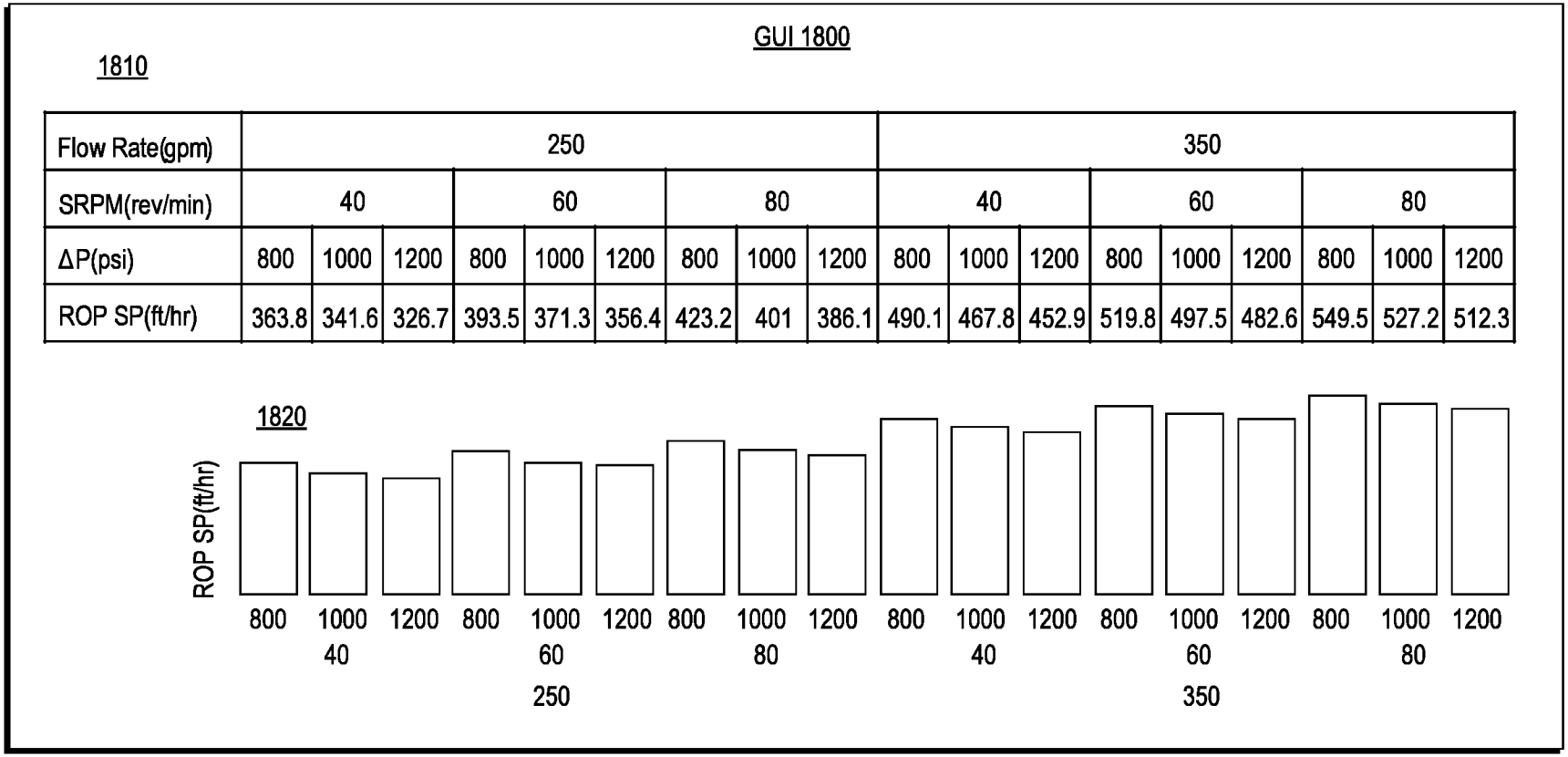
FIG. 18 illustrates an example of a graphical user interface.

FIG. 18 shows an example of a graphical user interface 1800 that includes an example table 1810 and an example plot 1820 of values for flow rate, SRPM (surface RPM provided by surface equipment), differential pressure and ROP set points for another combination of a bit and a mud motor.

FIG. 19 shows an example of a graphical user interface 1900 that includes stability rate of penetration (ROP) sensitivity data, which is coded with respect to factors such as lateral vibration risk, axial vibration risk and stick-slip risk.

In the example of FIG. 19, the GUI 1900 includes a sensitivity chart where data in the chart are generated via performing drilling simulations. The chart can be considered to be a matrix, which may, for example, be rendered to a display in a cabin (e.g., doghouse, etc.) at a rigsite where drilling operations are to occur, are occurring, etc. As explained, a rigsite can include various instrumentation such as, for example, one or more weight indicators, pressure indicators, revolution rate indicators, flow indicators, etc. As mentioned, such instrumentation may be analog and/or digital.

In the example of FIG. 19, the matrix shows values for simulated drilling scenarios with indications as to shock and vibration response at the bit. In the matrix (within the thick black line), each cell is one drilling scenario with a given flow rate, surface RPM (SRPM) and WOB where the differential pressure (DP) is output for a given WOB.

During planning and/or during execution, when choosing one or more drilling parameters, a method can include selecting one or more of the cells with less shock and vibration risks, and with higher ROP. For example, consider that running with WOB over 20 klbf will result in a higher risk of shock and vibration (see, e.g., "Lat(3.0)"). As such, a recommendation may be indicated (see, e.g., "Stable") to use a WOB that is below 20 klbf (e.g., greater than or equal to 15 klbf and less than 20 klbf). As an example, an operation may use differential pressure controlled drilling, where a recommendation can be to run a motor with a differential pressure lower than approximately 389 psi (see, e.g., "Lat (3.0)" and "Stable"). For example, consider an automated and/or semi-automated approach to drilling that can utilize differential pressure controlled drilling. In such an example, a controller may be set to operate in a differential pressure controlled drilling mode with a differential pressure setting point of 350 psi (e.g., lower than 389 psi where shock and vibration risks are low) and where the ROP set limit can then be determine using a suitable example workflow (see, e.g., FIG. 13, FIG. 20, FIG. 21, etc.). As an example, a workflow can include determining a maximum DOC of a bit; determining a total RPM of the bit by adding surface RPM (SRPM) and motor RPM where the motor RPM can be calculated using a differential pressure setting point, flow rate and motor characteristics; and determining a maximum ROP set limit for a controller. Such a method can include drilling using a maximum ROP set limit (e.g., a maximum ROP set point limit, etc.) where the drilling may be performed in an automated manner, a semi-automated manner, and/or in a manual manner (e.g., via one or more human input devices (HIDs) operatively coupled to drilling equipment, etc.).

As to various indications of vibrations in the example of FIG. 19, as an example, axial vibrations can cause bit bounce (e.g., consider shocks associated with bounces), which may damage bit cutters and bearings. Lateral vibrations can be a destructive type of vibration that can create large shocks as a BHA impacts a wellbore wall. The interaction between BHA and drillstring contact points may, in certain circumstances, drive a system into backward whirl. Backward whirl tends to be the most severe form of vibration, creating high-frequency large-magnitude bending moment fluctuations that result in high rates of component and connection fatigue. Imbalance in an assembly can cause centrifugally induced bowing of the drillstring, which may produce forward whirl and result in one-sided wear of components. Torsional vibrations can cause irregular downhole rotation. Stick-slip may be seen while drilling and can be a severe form of drillstring torsional oscillation in which the bit becomes stationary for a period. As severity of stick-slip increases, the length of the stuck period tends to increase, as do the rotational accelerations as the bit breaks free. Torsional fluctuations fatigue drill collar connections and can damage bits. A drilling operation that utilizes a mud motor may help to address stick-slip if a main source of excitation is from the bit, but the presence of a mud motor itself does not prevent stick-slip. For example, a drillstring and BHA above a mud motor can enter into a stick-slip motion even when the mud motor is turning the bit at a steady rate.

In the example of FIG. 19, stable regions of operational parameters are shown with respect to Diff. Press. (DP), WOB, SRPM (surface RPM as provided by surface equipment), and FLOW, where ROP is normalized by a factor of 150.12 feet per hour.

As an example, a trajectory may be defined in part by a measured depth (MD) metric, which may be, for example, 1000 meters or more. As an example, consider a trajectory for a well in the Permian Basin with a total measured depth of more than 1000 meters and a well plan that indicates three to ten trips for drilling three sections. In such an example, an ROP engine may be utilized to generate one or more ROP values that can account for bit and/or mud motor conditions. In such an example, by performing one or more drilling operations according to one or more of the ROP values, a number of trips may be reduced or otherwise optimized to a minimum. A reduction in number of trips can save considerable time as tripping out of a 5000 meter MD borehole may take hours (e.g., more than four hours). At times, a driller may aim to drill as fast as possible based on personal knowledge, which can give rise to uncertainties as to equipment and number of trips. An ROP engine can help to reduce such uncertainties and reduce demands placed on a driller as to drilling fast as the drill may drill according to a recommended, generated ROP value (or values). Where drilling occurs over days (e.g., or weeks), reduced demands placed on a driller can help a driller to focus on one or more other activities, concerns, etc. (e.g., safety of workers, etc.).

As an example, consider a drilling operation that is performed according to output of an ROP engine where, for example, drill cuttings as carried to surface by drilling fluid may be analyzed. In such an example, drill cuttings may be compared to data input to the ROP engine such as, for example, to a bit engine that can determine DOC data with respect to a formation. In such an example, where a mismatch exists between input to a bit engine and drill cuttings analysis output, the bit engine can be executed and the ROP engine can generate one or more revised ROP values. In such an example, a loop can exist that can cause an ROP engine to generate one or more revised ROP values based on data as to a formation being drilled.

As an example, where a trip is scheduled or otherwise called for, an ROP engine may be executed to determine one or more bit types and/or mud motor types that may be appropriate for continuing drilling upon tripping in. For example, consider a recommendation as to a bit and mud motor combination for an unplanned trip where the current bit and mud motor can be replaced once the drillstring has been tripped-out. Such an approach may provide for one or more of fewer future trips, a more optimal ROP, a reduction in total time, etc. As tripping out may take some hours, where a decision is made to replace a bit and/or a mud motor according to an ROP engine recommendation, surface activities may occur to facilitate making the replacement. For example, procuring the bit and/or mud motor (e.g., retrieving from stock, shipping in, etc.) and staging the bit and/or mud motor for replacement (e.g., positioning, preparing tools, etc.).

As explained, an ROP engine can help to reduce occurrences of unexpected damage while providing for an optimal ROP or a set of ROPs that may be associated with various types of risks (see, e.g., the GUI 1900 of FIG. 19). In such an approach, an ROP engine can provide one or more ROP set points, which can facilitate scheduling (see, e.g., the GUI 900 of FIG. 9) and reduce risk of changes to scheduling. As indicated in the GUI 900 of FIG. 9, for construction of the 8.5 inch section, drilling to depth (3530 ft to 6530 ft or 1076 m to 1990 m) is estimated to take approximately 103 hours, which is approximately 4.3 days. If an unexpected (e.g., unplanned) trip is demanded due to equipment condition, the time may be extended by half a day, which is an approximately 10 percent increase in the estimated time. If the equipment condition is due to engagement of a bit body with the formation being drilled, that can be an indication that a revision to an ROP value may be beneficial (e.g., per a bit engine). In such an example, an ROP engine may generate one or more revised ROP values using information (e.g., drill cuttings, condition of bit, etc.) such that risk of a repeated bit-related event is reduced and such that ROP is acceptable for the same type of bit and/or motor or for a different type of bit and/or motor.

Figure 20:
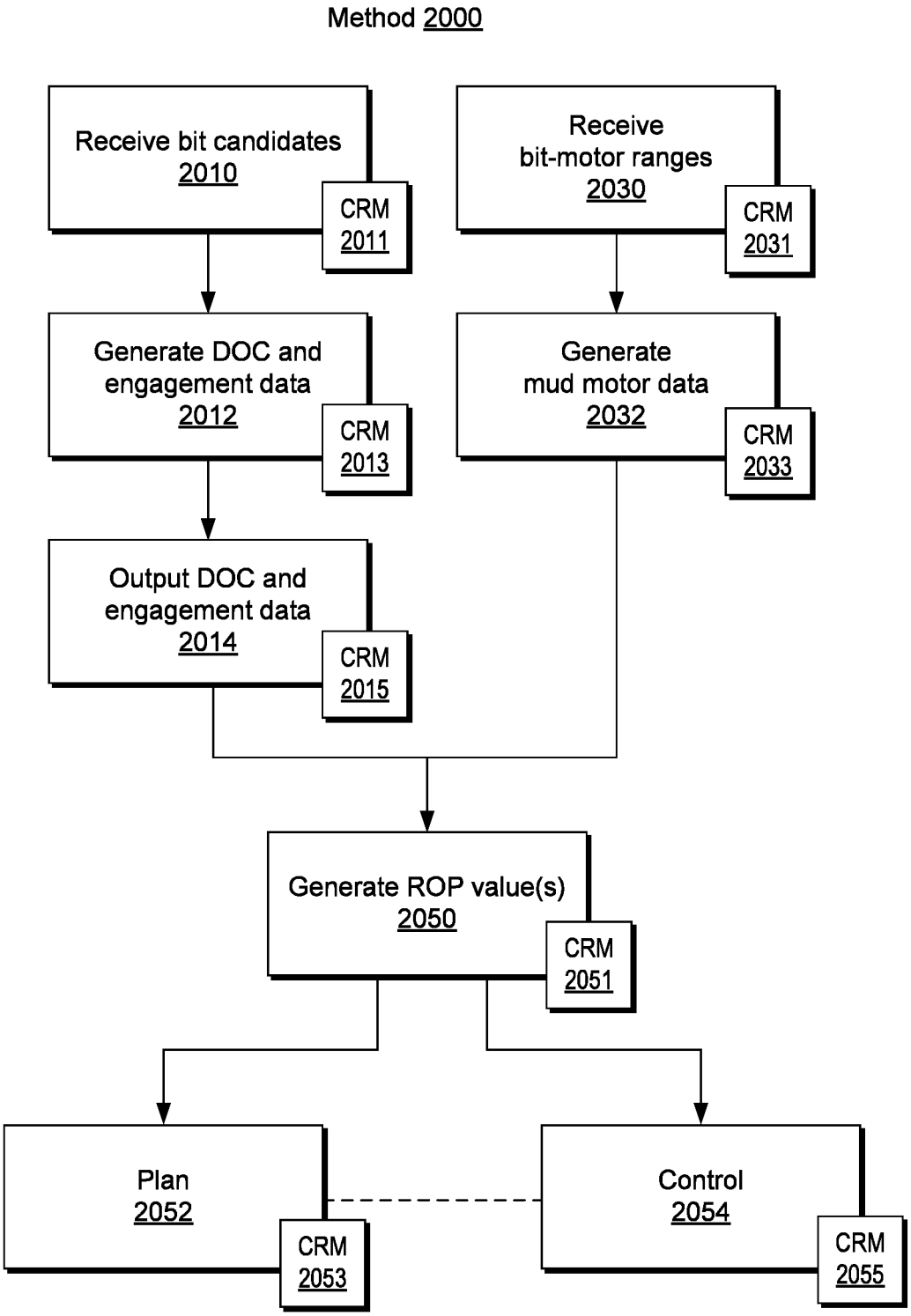
FIG. 20 illustrates an example of a method.

FIG. 20 shows an example of a method 2000 that includes a reception block 2010 for receiving bit candidates, a generation block 2012 for generating depth of cut (DOC) and engagement data, an output block 2014 for outputting the DOC and engagement data, a reception block 2030 for receiving bit-motor ranges, a generation block 2032 for generating mud motor data, a generation block 2050 for generating one or more rate of penetration (ROP) values, a plan block 2052 for generating a drilling operation plan using one or more of the one or more ROP values and a control block 2054 for controlling one or more drilling operations using one or more of the one or more ROP values. As an example, the method 2000 may utilize on or more features of the ROP engine 1000 of FIG. 10. For example, the blocks 2010, 2012 and 2014 may utilize the bit engine 1020 and the blocks 2030 and 2032 may utilize the mud motor engine 1040. As mentioned, the ROP engine 1000 may include one or more other features 1060.

In the example of FIG. 20, the method 2000 may be implemented in real-time where, for example, data acquired via one or more techniques (e.g., sensors, etc.) are utilized as feedback to one or more of the blocks 2010, 2012, 2014, 2030, 2032 and 2050, which can result in generation of one or more ROP values, optionally one or more revised ROP values.

In the example of FIG. 20, the block 2012 may output data such as the data of the GUI 1300 for one or more bits, for example, where depth of cut (DOC) can be determined where a bit top engages a formation (e.g., as to risk of bit body damage). As an example, a bit top may be defined by a portion of a blade or portions of blades. In such an example, the DOC may be defined as a maximum depth of cut (e.g., maximum DOC). As an example, a maximum DOC may be defined with respect to undesirable, detrimental contact between one or more portions of a bit and a formation (e.g., rock), which may place the bit at risk of damage (e.g., a shortened lifespan). As an example, the block 2012 may utilize a computational framework such as, for example, the IDEAS framework.

In the example of FIG. 20, the block 2030 may include receiving one or more recommended differential pressure ranges, one or more SRPM ranges, one or more flow rate ranges as may be associated with one or more bit and mud motor combinations. As an example, the block 2030 may include receiving one or more of the aforementioned ranges from operational data and/or real-time data. For example, consider operational data for a drilled section, a portion of a drilled section, a drilled offset well, etc. As to real-time data, such data may be germane to equipment and/or operational conditions at a site. For example, consider mud pump data as associated with one or more types of drilling fluids, which may provide indications as to a differential pressure range, a flow rate range and a SRPM range (e.g., as RPM is related to flow of drilling fluid). As to the block 2032, it can include motor power section characteristics, which may be in the form of a motor power section characteristic curve or curves (e.g., from specifications, a mud motor engine, test data for a mud motor engine, etc.).

As to the generation block 2050, it can utilize various information for generating one or more ROP values, which can be output as limits (e.g., set points, etc.) to guide a driller, to control drilling, etc. As an example, the method 2000 can include determining a maximum DOC for a bit when a blade top of the bit makes effective contact with a formation; determining a total RPM of a bit by adding surface RPM and motor RPM (e.g., where motor RPM can be determined by differential pressure setting point, flow rate and motor characteristics); and generating an ROP set limit by multiplying the maximum DOC (e.g., per revolution) with the total RPM.

As an example, the method 2000 can output one or more data structures that include one or more ROP values, for example, as shown in the example GUIs 1700 and 1800 of FIGS. 17 and 18, respectively. As an example, the method 2000 can output ROP set point recommendations in the form of a look-up table or other type of data structure. In such an example, the data structure can include flow rate, SRPM, differential pressure information that can be utilized to, given a flow rate, a SRPM and a differential pressure, determine a ROP set point.

The method 2000 of FIG. 20 is shown as including various computer-readable storage medium (CRM) blocks 2011, 2013, 2015, 2031, 2033, 2051, 2053, and 2055 that can include processor-executable instructions that can instruct a computing system, which can be a control system, to perform one or more of the actions described with respect to the method 2000. As an example, a system such as the system 470 of FIG. 4 may be utilized to implement one or more portions of the method 2000. As an example, the instructions 476 may include instructions executable by at least one of the one or more processors 472.

Figure 21:
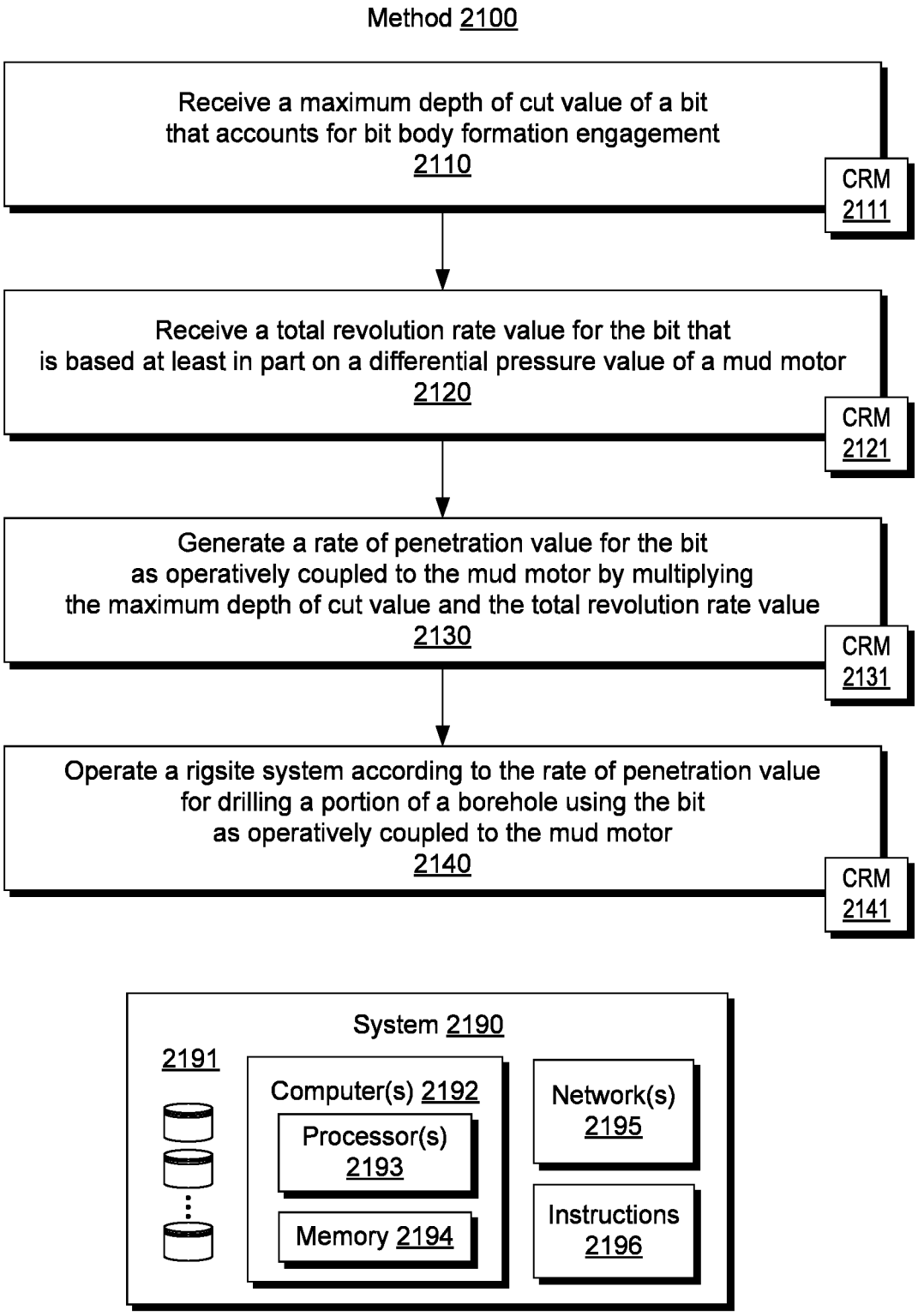
FIG. 21 illustrates an example of a method.

FIG. 21 shows an example of a method 2100 and an example of a system 2190. The method 2100 includes a reception block 2110 for receiving a maximum depth of cut value of a bit that accounts for bit body formation engagement; a reception block 2120 for receiving a total revolution rate value for the bit that is based at least in part on a differential pressure value of a mud motor; a generation block 2130 for generating a rate of penetration value for the bit as operatively coupled to the mud motor by multiplying the maximum depth of cut value and the total revolution rate value; and an operation block 2140 for operating a rigsite system according to the rate of penetration value for drilling a portion of a borehole using the bit as operatively coupled to the mud motor.

As to the generation block 2130, it may utilize an approach as explained with respect to the generation block 2050 of FIG. 20. As explained, a method can include determining a max ROP set limit according to a specific bit used, motor used, and a differential pressure set point.

As an example, a method can include determining the maximum depth of cut value of a bit that accounts for bit body formation engagement; determining a total RPM value of the bit by adding a surface RPM value and a mud motor RPM value where the mud motor RPM value is calculated using a differential pressure value (e.g., a differential pressure set point, etc.), a flow rate value and one or more mud motor characteristics; and generating a maximum ROP limit (e.g., set point limit) for performing drilling using the bit as operatively coupled to the mud motor. In such an example, the surface RPM value (SRPM) may be zero or a non-zero value. As mentioned, drilling may be via a mud motor or via a mud motor and one or more surface motors (e.g., a rotary table, a top drive, etc.).

The method 2100 is shown as including various computer-readable storage medium (CRM) blocks 2111, 2121, 2131, and 2141 that can include processor-executable instructions that can instruct a computing system, which can be a control system, to perform one or more of the actions described with respect to the method 2100.

In the example of FIG. 21, a system 2190 includes one or more information storage devices 2191, one or more computers 2192, one or more networks 2195 and instructions 2196. As to the one or more computers 2192, each computer may include one or more processors (e.g., or processing cores) 2193 and memory 2194 for storing the instructions 2196, for example, executable by at least one of the one or more processors 2193 (see, e.g., the blocks 2111, 2121, 2131 and 2141). As an example, a computer may include one or more network interfaces (e.g., wired or wireless), one or more graphics cards, a display interface (e.g., wired or wireless), etc.

As an example, the method 2100 may be a workflow that can be implemented using one or more frameworks that may be within a framework environment. As an example, the system 2190 can include local and/or remote resources. For example, consider a browser application executing on a client device as being a local resource with respect to a user of the browser application and a cloud-based computing device as being a remote resources with respect to the user. In such an example, the user may interact with the client device via the browser application where information is transmitted to the cloud-based computing device (or devices) and where information may be received in response and rendered to a display operatively coupled to the client device (e.g., via services, APIs, etc.).

Figure 22:
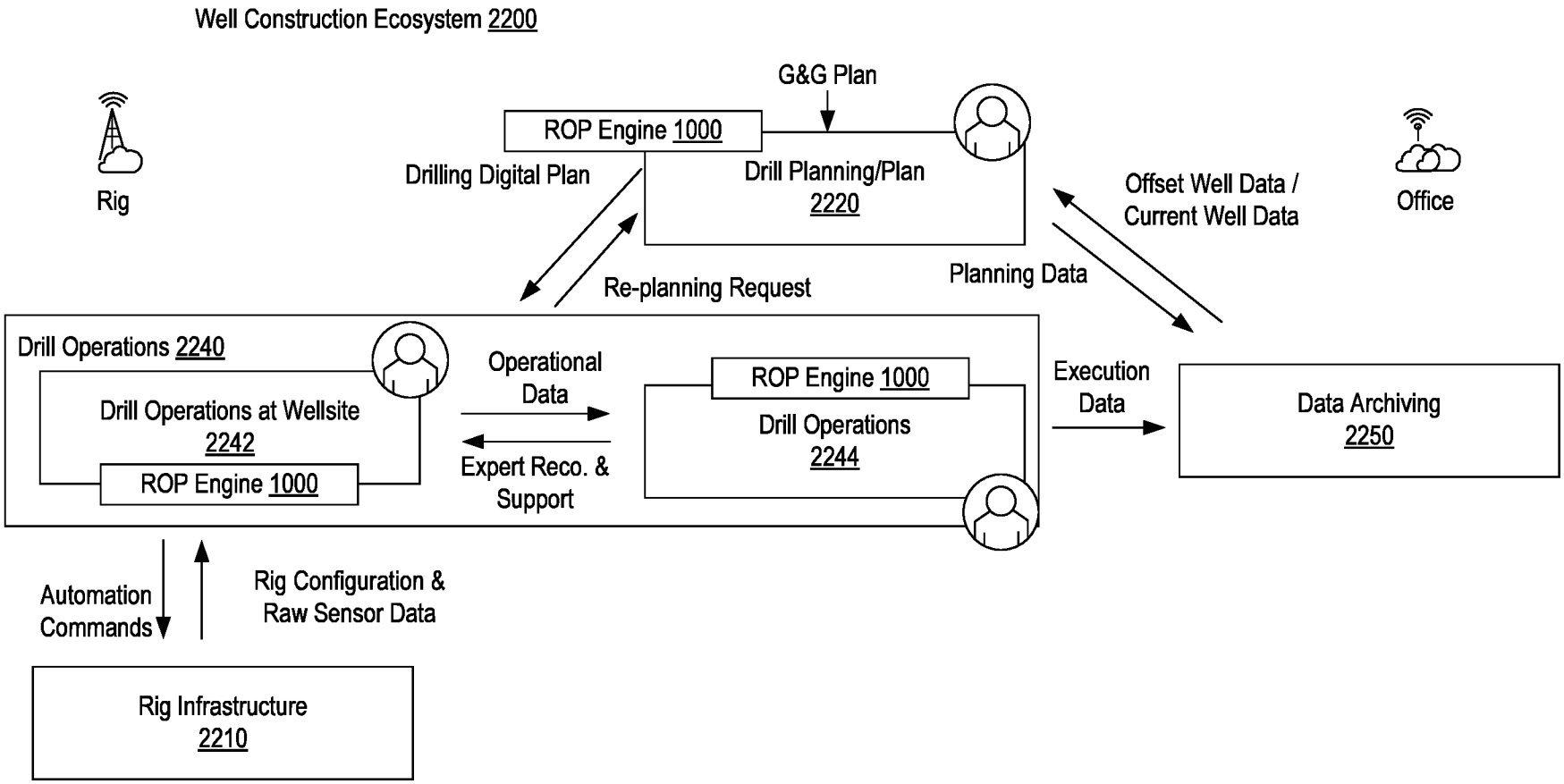
FIG. 22 illustrates an example of a well construction ecosystem that includes one or more rate of penetration engines.

FIG. 22 shows an example of a system 2200 that can be a well construction ecosystem. As shown, the system 2200 can include one or more instances of the ROP engine 1000 and can include a rig infrastructure 2210 and a drill plan component 2220 that can generation or otherwise transmit information associated with a plan to be executed utilizing the rig infrastructure 2210, for example, via a drilling operations layer 2240, which includes a wellsite component 2242 and an offsite component 2244. As shown, data acquired and/or generated by the drilling operations layer 2240 can be transmitted to a data archiving component 2250, which may be utilized, for example, for purposes of planning one or more operations (e.g., per the drilling plan component 2220).

In the example of FIG. 22, the ROP engine 1000 is shown as being implemented with respect to the drill plan component 2220, the wellsite component 2242 and/or the offsite component 2244.

As an example, the ROP engine 1000 can interact with one or more of the components in the system 2200. As shown, the ROP engine 1000 can be utilized in conjunction with the drill plan component 2220. In such an example, data accessed from the data archiving component 2250 may be utilized to assess output of the ROP engine 1000 or, for example, may be utilized as input to the ROP engine 1000. As an example, the data archiving component 2250 can include drilling data for one or more offset wells and/or one or more current wells pertaining to specifications for and/or operations of one or more types of bits, one or more types of mud motors, etc. In such an example, the drilling data can include going on bottom data where a drill bit engages a formation at the bottom of a borehole to drill into the formation. As an example, such data may be utilized in combination with a framework such as, for example, the IDEAS framework. As an example, such data may be utilized in combination with the bit engine 1020 of FIG. 10. As an example, such data may include mud motor operational data that may be utilized, for example, in combination with the mud motor engine 1040. As shown in FIG. 22, various components of the drilling operations layer 2240 may utilize the ROP engine 1000 and/or a drilling digital plan as output by the drill plan component 2220. During drilling, execution data can be acquired, which may be utilized by the ROP engine 1000, for example, to update one or more ROP values (e.g., ROP limits, etc.). Such execution data can be archived in the data archiving component 2250, which may be archived during one or more drill operations and may be available by the drill plan component 2220, for example, for re-planning, etc. As an example, execution data can include going on bottom data, which as mentioned, can be utilized by an ROP engine 1000 and/or in combination with the ROP engine 1000.

As an example, going on bottom data can include data pertaining to a bit tagging bottom, which may include data such as weight on bit, and can include data pertaining to rotation of a bit via a mud motor and/or surface equipment. As an example, the system 2200 may aim to optimize going on bottom in a manner that comports with one or more ROP limits. For example, optimization can include reduction of risk of damage to a hole, to a bit and/or a mud motor. As an example, optimization may account for formation cuttings that may have migrated to the bottom of a hole, for example, during a connection (e.g., adding pipe, etc.). As an example, one or more types of data may be utilized to determine if a bit has tagged bottom, including, for example, a decrease in hookload corresponding to a bit taking weight, an increase in surface torque as a bit begins to engage with material at the bottom of the hole, an increase in standpipe pressure as bit nozzle flow starts to encounter more resistance and/or if a mud motor is running as the bit reaches material at the bottom of the hole. As shown in the example GUI 1100, one or more ROP set points and/or one or more ROP limits may be utilized during drilling, which may be periodic (e.g., in a pipe by pipe or stand by stand manner, in a state-based manner, etc.).

As explained, drilling can increase the depth of a bore. As an example, during non-drilling (e.g., a non-drilling state), flow rate of fluid being pumped into a drillstring may increase and/or decrease, rate of rotation of a drillstring may increase and/or decrease, a drill bit may move upwards and/or downwards, or a combination thereof. A non-drilling activity may be or include a time when a drill bit is idle (e.g., not drilling) and a slips assembly is not engaged with a drillstring.

As an example, pre-connection can refer to a state where a drill bit has completed drilling operations for a current section of pipe, etc., but the slips assembly has not begun to move (e.g., radially-inward) into engagement with the drillstring. During pre-connection, the flow rate of fluid being pumped into the drillstring may increase and/or decrease, the rate of rotation of the drillstring may increase and/or decrease, the drill bit may move upwards and/or downwards, or a combination thereof.

As an example, connection can refer to a state where a slips assembly is engaged with, and supports, a drillstring (e.g., the drillstring is "in-slips"). When a connection is occurring, a segment (e.g., a pipe, a stand, etc.) may be added to the drillstring to increase the length of the drillstring, or a segment may be removed from the drillstring to reduce the length of the drillstring.

As an example, post-connection can refer to a state where the drillstring is released by a slips assembly and the drillstring with a drill bit is lowered to be on-bottom (e.g., bottom of hole or BOH). During post-connection, the flow rate of fluid being pumped into a drillstring may increase and/or decrease, the rate of rotation of a drillstring may increase and/or decrease, the drill bit may move upwards and/or downwards, or a combination thereof.

As an example, a method can include drilling according to one or more generated ROP values, which may be one or more ROP set points and/or one or more ROP limits. In such an example, a drilling system may be classified according to one or more states of operation (e.g., a drilling state, etc.). As an example, a transition to a drilling state can trigger use of one or more ROP values (e.g., as generated by the ROP engine 1000). As explained with respect to the GUI 1900 of FIG. 19, various factors may be taken into account for selecting an ROP value. As mentioned, an ROP value may be selected based at least in part on risk of vibration and/or stick-slip risk.

As shown in the method 2000 of FIG. 20, one or more generated ROP values (e.g., as generated by the ROP engine 1000) may be utilized for planning (e.g., per the plan block 2052) and/or may be utilized for controlling (e.g., per the control block 2054). As an example, one or more actions of the method 2000 of FIG. 20 and/or the method 2100 of FIG. 21 may be utilized by the system 2200 of FIG. 22.

As an example, a method can include receiving a maximum depth of cut value of a bit that accounts for bit body formation engagement; receiving a total revolution rate value for the bit that is based at least in part on a differential pressure value of a mud motor; generating a rate of penetration value for the bit as operatively coupled to the mud motor by multiplying the maximum depth of cut value and the total revolution rate value; and operating a rigsite system according to the rate of penetration value for drilling a portion of a borehole using the bit as operatively coupled to the mud motor. In such an example, the rate of penetration (ROP) value can be a set point or a limit (see, e.g., the GUI 1100 of FIG. 11, etc.).

As an example, a rate of penetration value can be generated for a flow rate of drilling fluid, which, as explained, can be utilized to drive a mud motor (see, e.g., the motor section 1410 of FIG. 14).

As an example, a rate of penetration value can be generated for a surface revolution rate value of surface equipment of a rigsite system that rotates a drillstring that includes a bit and a mud motor.

As an example, a maximum depth of cut value can account for one or more button-shaped features that protect the bit from bit-formation bouncing. For example, consider a tungsten carbide type of button-shaped feature that can be included on a bit.

As an example, a method can include rendering a rate of penetration value to a display operatively coupled to a controller of a rigsite system (see, e.g., the system 470 of FIG. 4, the system 2200 of FIG. 22, etc.).

As an example, a method can include setting a rate of penetration set point using a rate of penetration value and, for example, controlling equipment of the rigsite system using the rate of penetration set point (see, e.g., the GUI 1100 of FIG. 11).

As an example, drilling can include drilling in a sliding mode and/or drilling in a rotating mode (see, e.g., the GUI 700 of FIG. 7).

As an example, a method can include generating sensitivity information for a plurality of differential pressure values having one or more corresponding rate of penetration values, where the sensitivity information indicates vibration risk (see, e.g., the GUI 1900 of FIG. 19). In such an example, each of the plurality of differential pressure values can include a corresponding surface revolution rate value, each of the plurality of differential pressure values can include a corresponding weight on bit value, each of the plurality of differential pressure values can include a corresponding surface revolution rate value and a corresponding flow rate value, each of the plurality of differential pressure values can include a corresponding weight on bit value, a corresponding surface revolution rate value, and a corresponding flow rate value. As an example, a vibration risk can include at least one of lateral vibration risk and axial vibration risk. As an example, drilling can include utilizing one of one or more corresponding rate of penetration values as a rate of penetration set point (e.g., or limit) and utilizing one of the plurality of differential pressure values as a differential pressure set point (e.g., or limit).

As an example, a method can include generating sensitivity information for a plurality of weight on bit values having one or more corresponding rate of penetration values, where the sensitivity information indicates vibration risk. In such an example, drilling can include utilizing one of the one or more corresponding rate of penetration values as a rate of penetration set point (e.g., or limit) and utilizing one of the plurality of weight on bit values as a weight on bit set point (e.g., or limit).

As an example, a method can include changing a rate of penetration set point responsive to analyzing drill cuttings generated by the drilling. For example, consider analyzing drill cuttings for an indication that a formation property of a formation drilled does not match a formation property of bit body formation engagement data (e.g., as utilized to determine a maximum depth of cut value). As an example, drill cuttings may be, for example, cutting of rock that are carried by drilling fluid (e.g., mud) to surface.

As an example, a method can include, responsive to a decision for halting drilling and tripping out, assessing one or more rate of penetration values to select a bit, a mud motor or a bit and mud motor combination for tripping in and subsequent drilling.

As an example, a bit body formation engagement data can include data for matrix body bits. As an example, bit body formation engagement data can include data for one or more button-shaped features of a bit.

As an example, a method can include generating rate of penetration stability sensitivity data with respect to at least one type of vibration. For example, consider axial vibration and/or lateral vibration.

As an example, drilling can include directional drilling. As an example, drilling can be performed according to a borehole trajectory that includes a dogleg.

As an example, drilling can be performed according to a digital plan that includes one or more generated ROP values that can be utilized as one or more set points and/or one or more limits during drilling (e.g., execution of the digital plan). As an example, one or more signals may trigger changing a set point and/or a limit or limits using one or more generated ROP values. As an example, a system such as the system 2200 of FIG. 22 may be utilized for one or more phases of development of a reservoir for production of fluid from the reservoir via a borehole drilled into the reservoir and completed to form a well (e.g., a production well) and/or for injection of fluid into the reservoir via a borehole drilled into the reservoir and completed to form a well (e.g., an injection well).

As an example, a system can include a processor; memory accessible by the processor; processor-executable instructions stored in the memory and executable to instruct the system to: receive a maximum depth of cut value of a bit that accounts for bit body formation engagement; receive a total revolution rate value for the bit that is based at least in part on a differential pressure value of a mud motor; generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor.

As an example, one or more computer-readable storage media can include processor-executable instructions to instruct a computing system to: receive a maximum depth of cut value of a bit that accounts for bit body formation engagement; receive a total revolution rate value for the bit that is based at least in part on a differential pressure value of a mud motor; generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor.

As an example, a method may be implemented in part using computer-readable media (CRM), for example, as a module, a block, etc. that include information such as instructions suitable for execution by one or more processors (or processor cores) to instruct a computing device or system to perform one or more actions. As an example, a single medium may be configured with instructions to allow for, at least in part, performance of various actions of a method. As an example, a computer-readable medium (CRM) may be a computer-readable storage medium (e.g., a non-transitory medium) that is not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 23:
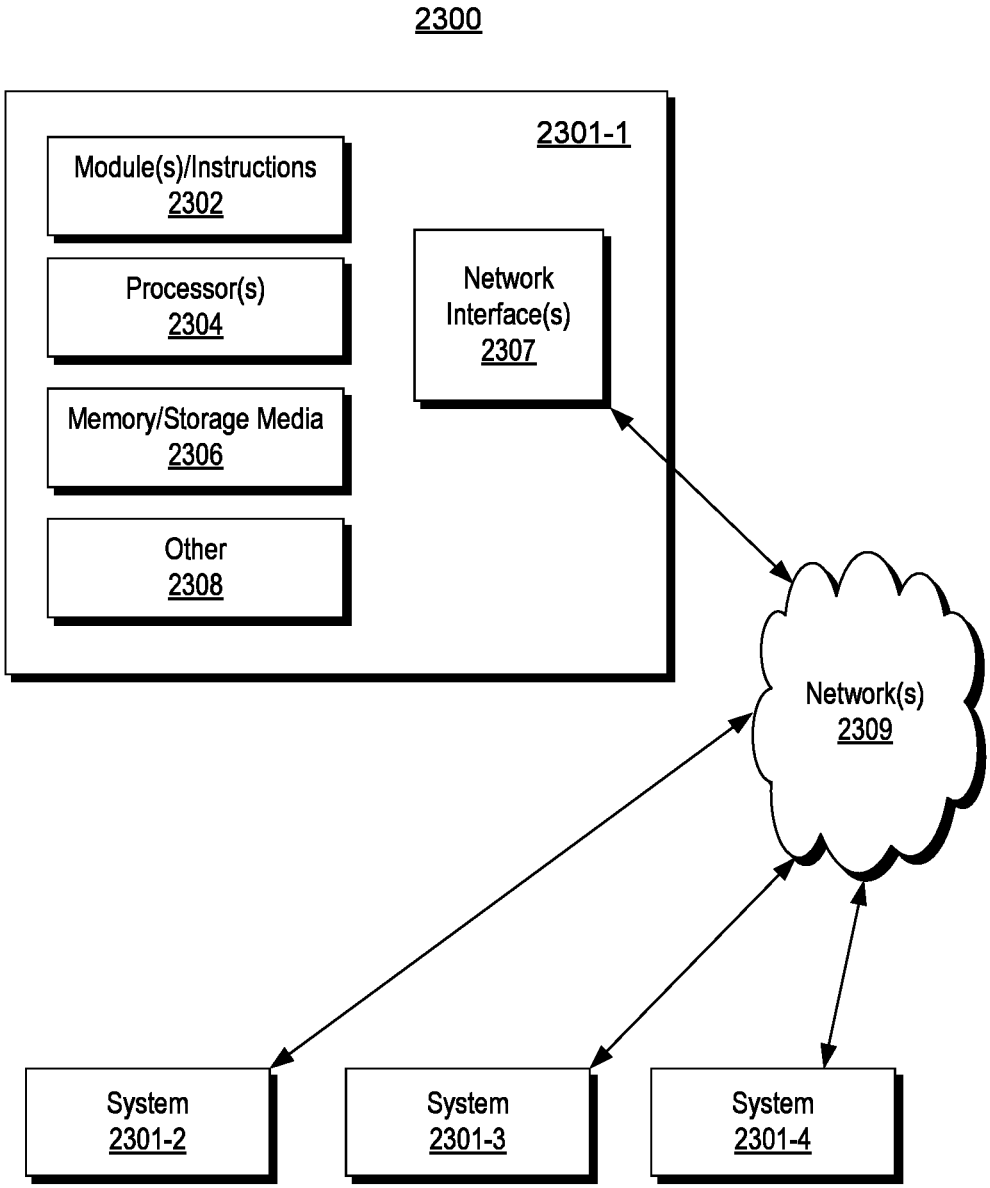
FIG. 23 illustrates an example of computing system.

In some embodiments, a method or methods may be executed by a computing system. FIG. 23 shows an example of a system 2300 that can include one or more computing systems 2301-1, 2301-2, 2301-3 and 2301-4, which may be operatively coupled via one or more networks 2309, which may include wired and/or wireless networks.

As an example, a system can include an individual computer system or an arrangement of distributed computer systems. In the example of FIG. 23, the computer system 2301-1 can include one or more modules 2302, which may be or include processor-executable instructions, for example, executable to perform various tasks (e.g., receiving information, requesting information, processing information, simulation, outputting information, etc.).

As an example, a module may be executed independently, or in coordination with, one or more processors 2304, which is (or are) operatively coupled to one or more storage media 2306 (e.g., via wire, wirelessly, etc.). As an example, one or more of the one or more processors 2304 can be operatively coupled to at least one of one or more network interface 2307. In such an example, the computer system 2301-1 can transmit and/or receive information, for example, via the one or more networks 2309 (e.g., consider one or more of the Internet, a private network, a cellular network, a satellite network, etc.).

As an example, the computer system 2301-1 may receive from and/or transmit information to one or more other devices, which may be or include, for example, one or more of the computer systems 2301-2, etc. A device may be located in a physical location that differs from that of the computer system 2301-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 2306 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

FIG. 24 shows components of a computing system 2400 and a networked system 2410. The system 2400 includes one or more processors 2402, memory and/or storage components 2404, one or more input and/or output devices 2406 and a bus 2408. According to an embodiment, instructions may be stored in one or more computer-readable media (e.g., memory/storage components 2404). Such instructions may be read by one or more processors (e.g., the processor(s) 2402) via a communication bus (e.g., the bus 2408), which may be wired or wireless. The one or more processors may execute such instructions to implement (wholly or in part) one or more attributes (e.g., as part of a method). A user may view output from and interact with a process via an I/O device (e.g., the device 2406). According to an embodiment, a computer-readable medium may be a storage component such as a physical memory storage device, for example, a chip, a chip on a package, a memory card, etc.

According to an embodiment, components may be distributed, such as in the network system 2410. The network system 2410 includes components 2422-1, 2422-2, 2422-3, . . . 2422-N. For example, the components 2422-1 may include the processor(s) 2402 while the component(s) 2422-3 may include memory accessible by the processor(s) 2402. Further, the component(s) 2422-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

receiving a maximum depth of cut value of a bit that accounts for bit body formation engagement;

receiving a total revolution rate value for the bit that is based at least in part on a differential pressure value of a mud motor;

generating a rate of penetration value for the bit as operatively coupled to the mud motor by multiplying the maximum depth of cut value and the total revolution rate value; and operating a rigsite system according to the rate of penetration value for drilling a portion of a borehole using the bit as operatively coupled to the mud motor.

2. The method of claim 1 wherein the rate of penetration value is generated for a flow rate of drilling fluid.

3. The method of claim 1 wherein the rate of penetration value is generated for a surface revolution rate value of surface equipment of the rigsite system that rotates a drillstring that comprises the bit and the mud motor.

4. The method of claim 1 wherein the maximum depth of cut value accounts for one or more button-shaped features that protect the bit from bit-formation bouncing.

5. The method of claim 1 comprising rendering the rate of penetration value to a display operatively coupled to a controller of the rigsite system.

6. The method of claim 1 comprising setting a rate of penetration set point using the rate of penetration value.

7. The method of claim 6 comprising controlling equipment of the rigsite system using the rate of penetration set point.

8. The method of claim 1 wherein the drilling comprises drilling in a sliding mode.

9. The method of claim 1 wherein the drilling comprises drilling in a rotating mode.

10. The method of claim 1 comprising generating sensitivity information for a plurality of differential pressure values having one or more corresponding rate of penetration values, wherein the sensitivity information indicates vibration risk.

11. The method of claim 10 wherein each of the plurality of differential pressure values comprises a corresponding surface revolution rate value.

12. The method of claim 10 wherein each of the plurality of differential pressure values comprises a corresponding weight on bit value.

13. The method of claim 10 wherein each of the plurality of differential pressure values comprises a corresponding surface revolution rate value and a corresponding flow rate value.

14. The method of claim 10 wherein each of the plurality of differential pressure values comprises a corresponding weight on bit value, a corresponding surface revolution rate value, and a corresponding flow rate value.

15. The method of claim 10 wherein the vibration risk comprises at least one of lateral vibration risk and axial vibration risk.

16. The method of claim 10 wherein the drilling comprises utilizing one of the one or more corresponding rate of penetration values as a rate of penetration set point and utilizing one of the plurality of differential pressure values as a differential pressure set point.

17. The method of claim 1 comprising generating sensitivity information for a plurality of weight on bit values having one or more corresponding rate of penetration values, wherein the sensitivity information indicates vibration risk.

18. The method of claim 17 wherein the drilling comprises utilizing one of the one or more corresponding rate of penetration values as a rate of penetration set point and utilizing one of the plurality of weight on bit values as a weight on bit set point.

19. A system comprising:

a processor;

memory accessible by the processor;

processor-executable instructions stored in the memory and executable to instruct the system to:

receive a maximum depth of cut value of a bit that accounts for bit body formation engagement;

receive a total revolution rate value for the bit that is based at least in part on a differential pressure value of a mud motor;

generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor.

20. One or more non-transitory computer-readable storage media comprising processor-executable instructions to instruct a computing system to:

receive a maximum depth of cut value of a bit that accounts for bit body formation engagement;

receive a total revolution rate value for the bit that is based at least in part on a differential pressure value of a mud motor;

generate a rate of penetration value for the bit as operatively coupled to the mud motor by multiplying the maximum depth of cut value and the total revolution rate value; and operate a rigsite system according to the rate of penetration value for drilling a portion of a borehole using the bit as operatively coupled to the mud motor.

* * * * *